US009113760B2

(12) United States Patent
Knapp et al.

(10) Patent No.: US 9,113,760 B2
(45) Date of Patent: Aug. 25, 2015

(54) LOW-MATERIAL-INDICATING CENTER PULL DISPENSER

(75) Inventors: Kevin Roland Knapp, Green Bay, WI (US); Alan J. Pierquet, Green Bay, WI (US)

(73) Assignee: Alwin Manufacturing Co., Inc., Green Bay, WI (US)

( * ) Notice: Subject to any disclaimer, the term of this patent is extended or adjusted under 35 U.S.C. 154(b) by 178 days.

(21) Appl. No.: 13/312,094

(22) Filed: Dec. 6, 2011

(65) Prior Publication Data

US 2013/0140340 A1 Jun. 6, 2013

(51) Int. Cl.

| | |
|---|---|
| ***A47K 10/38*** | (2006.01) |
| ***A47K 10/32*** | (2006.01) |
| ***B65H 63/00*** | (2006.01) |

(52) U.S. Cl.

CPC ..... *A47K 10/3818* (2013.01); *A47K 2010/324* (2013.01); *Y10T 225/246* (2015.04)

(58) Field of Classification Search

CPC ..... A47K 10/38; A47K 10/32; B65H 63/00
USPC ..... 221/46, 2, 6; 242/593, 563, 912, 56, 242/563.2, 590, 595.1; 225/46; 116/243; 312/234

See application file for complete search history.

(56) References Cited

U.S. PATENT DOCUMENTS

| | | | | |
|---|---|---|---|---|
| 3,298,604 | A * | 1/1967 | Arnold | 235/87 R |
| 3,638,118 | A * | 1/1972 | Mackenzie | 324/146 |
| 4,206,858 | A | 6/1980 | DeLuca et al. | |
| 4,760,970 | A * | 8/1988 | Larsson et al. | 242/422.5 |
| 5,000,393 | A | 3/1991 | Madsen | |
| 5,205,455 | A | 4/1993 | Moody | |
| 5,215,211 | A * | 6/1993 | Eberle | 221/1 |
| 5,263,607 | A | 11/1993 | Temesvary et al. | |
| 5,310,083 | A * | 5/1994 | Rizzuto | 221/63 |
| 5,346,064 | A | 9/1994 | Rizzuto | |
| 5,715,971 | A * | 2/1998 | Morand | 221/45 |
| 6,024,322 | A | 2/2000 | Skelly et al. | |
| 6,129,240 | A * | 10/2000 | Morand | 221/63 |
| 6,145,782 | A * | 11/2000 | King et al. | 242/593 |
| 6,282,807 | B1 | 9/2001 | Johnson | |
| 6,328,252 | B1 * | 12/2001 | Neveu et al. | 242/593 |
| 6,517,025 | B1 * | 2/2003 | Budz | 242/563 |

(Continued)

OTHER PUBLICATIONS

PCT International Application No. PCT/US2011/63449. International Search Report and Written Opinion. Date: Apr. 5, 2012 (13 pages).

*Primary Examiner* — Rakesh Kumar
(74) *Attorney, Agent, or Firm* — Jansson Munger McKinley and Shape Ltd.

(57) ABSTRACT

A low-material-indicating center pull dispenser for dispensing a web of material from a center pull roll. In embodiments, the dispenser includes a housing and a roll support platform which supports the center pull roll when loaded within the housing. The preferred roll support platform has an inward portion positioned to support a center pull roll inner region and a lower outward portion positioned to support the center pull roll outer region when the material forming the center pull roll inner region is depleted and the center pull roll drops onto the lower outward portion and changes position thereby providing a low-material indication. The change of center pull roll position may be viewed by center pull roll viewing structure such as at least one window, and/or a light transmissive housing or a housing portion.

22 Claims, 22 Drawing Sheets

(56) References Cited

U.S. PATENT DOCUMENTS

| | | | | |
|---|---|---|---|---|
| 6,575,397 | B1 * | 6/2003 | Tramontina et al. | 242/593 |
| 6,629,667 | B2 * | 10/2003 | Tramontina | 242/593 |
| 6,769,589 | B2 | 8/2004 | Paukov | |
| 6,908,059 | B2 | 6/2005 | Budz et al. | |
| 7,275,672 | B2 * | 10/2007 | Haen et al. | 225/106 |
| 7,434,760 | B2 | 10/2008 | Budz et al. | |
| 7,472,802 | B2 * | 1/2009 | van Riel | 221/6 |
| 7,530,460 | B2 * | 5/2009 | Lewis et al. | 206/409 |
| 7,546,973 | B2 | 6/2009 | Budz et al. | |
| 7,648,098 | B2 * | 1/2010 | Goeking et al. | 242/563 |
| 2008/0073456 | A1 * | 3/2008 | Goeking et al. | 242/563 |
| 2010/0314485 | A1 * | 12/2010 | Anderson | 242/593 |
| 2013/0068155 | A1 * | 3/2013 | Patel | 116/201 |
| 2014/0144366 | A1 * | 5/2014 | Huffman et al. | 116/216 |

* cited by examiner

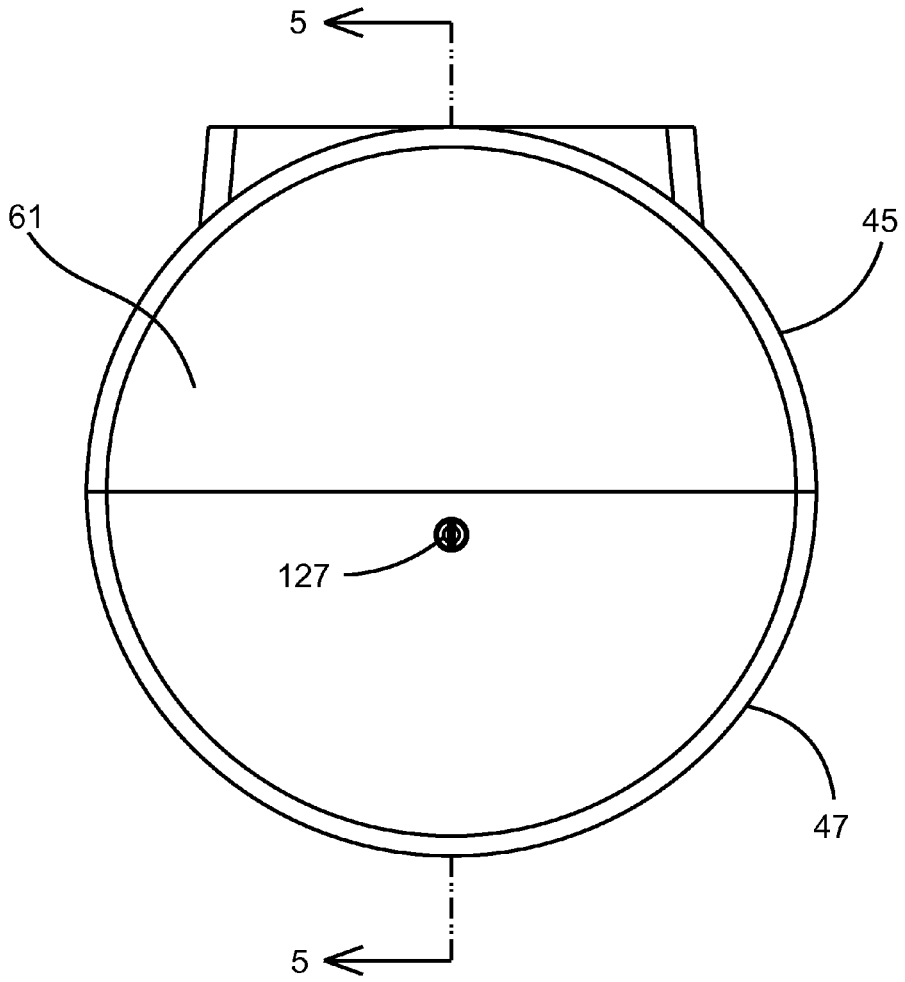
FIG. 1-A

LOW-MATERIAL-INDICATING CENTER PULL DISPENSER

FIELD

This invention is related generally to dispenser apparatus and, more particularly, to dispenser apparatus capable of providing a low-material indication when a web of material dispensed from the dispenser approaches depletion.

BACKGROUND

Center pull dispensers for dispensing flexible material, such as paper and cloth towel, tissue and the like, are well known in the art. Center pull dispensers are provided to dispense material in the form of a continuous web from a center pull roll. Center pull rolls are also referred to as coreless rolls. Center pull dispensers are typically designed so that the center pull roll is upright within the dispenser with the center pull roll center axis oriented vertically. The center pull roll is not wound on a core and the web of material is unwound from an inner periphery of the coreless center pull roll. The unwinding occurs when a user pulls on the tail of the web of material which extends out of the dispenser. The radial thickness of the center pull roll gradually diminishes from the center pull roll inner periphery toward the center pull roll outer periphery as the material is pulled from the dispenser by users.

The web of material is typically divided into discrete sheets by spaced-apart, transverse lines of perforations. A friction force, or drag, applied by the dispenser to the material as the material is pulled from the dispenser by a user causes a single leading sheet to separate from the adjacent sheet along the perforation line.

Various low-paper indicators have been proposed for use with center pull dispensers. However, these indicators are reliant upon paper followers, linkages and complex parts which add cost and complexity to manufacture of the center pull dispensers. The marketplace for center pull dispensers is hyper competitive and small differences in dispenser price can be of great importance in customer purchasing decisions.

It would be a significant improvement in the art to provide a low-material-indicating center pull dispenser which would reliably provide information indicating whether the web of material wound into the center pull roll is running low, which would be simple to use and which would reduce manufacturing cost.

SUMMARY

Embodiments of a low-material-indicating center pull dispenser for use in dispensing a web of material from a center pull, or coreless, roll are described herein. In an embodiment, the low-material-indicating center pull dispenser comprises a housing having a cover and further comprises a roll support platform. The roll support platform is preferably within the housing and supports a center pull roll of material when placed thereon. The center pull roll is preferably supported by the roll support platform in a substantially vertically-oriented position so that material can be unwound from an inner periphery of the center pull roll. The tail of the web of material preferably extends from the housing through a housing outlet, thereby permitting a user to grab and pull the material from the center pull dispenser.

The center pull roll dispensed by the center pull dispenser has a coiled bottom surface formed by winding of the material into the center pull roll during manufacture of the center pull roll. The coiled bottom surface can be demarcated into inner and outer regions. Preferably, the inner and outer regions are generally concentric about a center axis of the center pull roll. As material is unwound from the center pull roll inner periphery toward the center pull roll outer periphery, the surface area comprising the inner region of the center pull roll radially decreases until the center pull roll inner region is consumed.

In an embodiment, the roll support platform has an inward portion and a lower outward portion. The inner region of the center pull roll bottom is initially supported by the roll support platform inward portion, thereby providing support for the entire center pull roll. In such embodiment, the outer region of the center pull roll bottom surface overhangs at least a portion of the lower roll support platform outward portion while the center pull roll is supported on the roll support platform inward portion. In an embodiment, the preferred inward portion further defines a central dispensing opening through which the material is pulled from the center pull roll.

The roll support platform lower outward portion is preferably positioned to support the center pull roll outer region when the material forming the inner region of the center pull roll bottom surface is consumed. When the inner region of the center pull roll bottom surface is consumed, the center pull roll is no longer supported on the roll support platform inward portion and the center pull roll drops, or falls, onto the outward portion, preferably by means of gravity. The change of position of the center pull roll provides a low-material indication.

In an embodiment, the dispenser housing further includes center pull roll viewing structure permitting viewing of the center pull roll in the housing. In an embodiment, the center pull roll viewing structure comprises at least one window. More than one window may be provided. The at least one window may be located on the housing so that the center pull roll is viewable both before and after the change of center pull roll position, or is viewable only before the change of center pull roll position or is viewable only after the change of center pull roll position. In an embodiment, the at least one window is located on a housing cover. Preferably, a light-transmissive cover is provided over the at least one window to prevent contaminants from contacting the center pull roll.

In a further embodiment, the center pull roll viewing structure comprises a light-transmissive portion of the housing which permits viewing of the center pull roll through the housing to permit the change of center pull roll position to be viewed. The light-transmissive portion may be located on a housing cover.

In a preferred embodiment, the roll support platform inward portion has a surface and the roll support platform lower outward portion has a surface around the inward portion. Preferably, the roll support platform lower outward portion forms an annular surface concentric with the roll support platform inward portion. In a further embodiment, a ramp spaces the roll support platform inward portion from the roll support platform lower outward portion. Preferably, the ramp is outwardly tapered toward the roll support platform lower outward portion and the outward taper can help center the center pull roll as it drops down onto the lower outward portion of the roll support platform and provides a smooth surface over which material can be pulled out of the dispenser. An upright rim may be provided around the roll support platform lower outward portion. In an embodiment, the rim is continuous and in other embodiments the rim is discontinuous. If provided, the upright rim helps guide movement of the center pull roll to the lower outward portion of the roll support platform.

In an embodiment, at least one position indicator may be provided to facilitate recognition of the change of position of the center pull roll. For example, the at least one position indicator could include indicia behind the center pull roll viewable through the window once the center pull roll has begun to change position. In another example, the at least one position indicator could comprise indicia such as a line or other marking facilitating recognition that the center pull roll has changed position.

In embodiments, the center pull dispenser includes at least one friction-providing surface which contacts the material pulled through the central dispensing opening. The friction-providing surface enables a single sheet of material to separate from an adjacent sheet along a perforation line when pulled by a user. In a further embodiment, a dispenser element extending away from the platform in communication with the central opening is provided. In such embodiment, the friction-providing surface comprises a lower wall of the dispenser element which defines an orifice through which the towel is pulled from the center pull roll and out of the center pull dispenser.

BRIEF DESCRIPTION OF THE DRAWINGS

Exemplary low-material-indicating center pull dispensers may be understood by reference to the following description taken in conjunction with the accompanying drawings, in which like reference numbers identify like elements throughout the different views. The drawings are not necessarily to scale, emphasis instead being placed upon illustrating the principles of the invention. In the accompanying drawings:

FIG. 1-A is a top plan view of the dispenser of FIG. 1;

DETAILED DESCRIPTION

Figure 1:
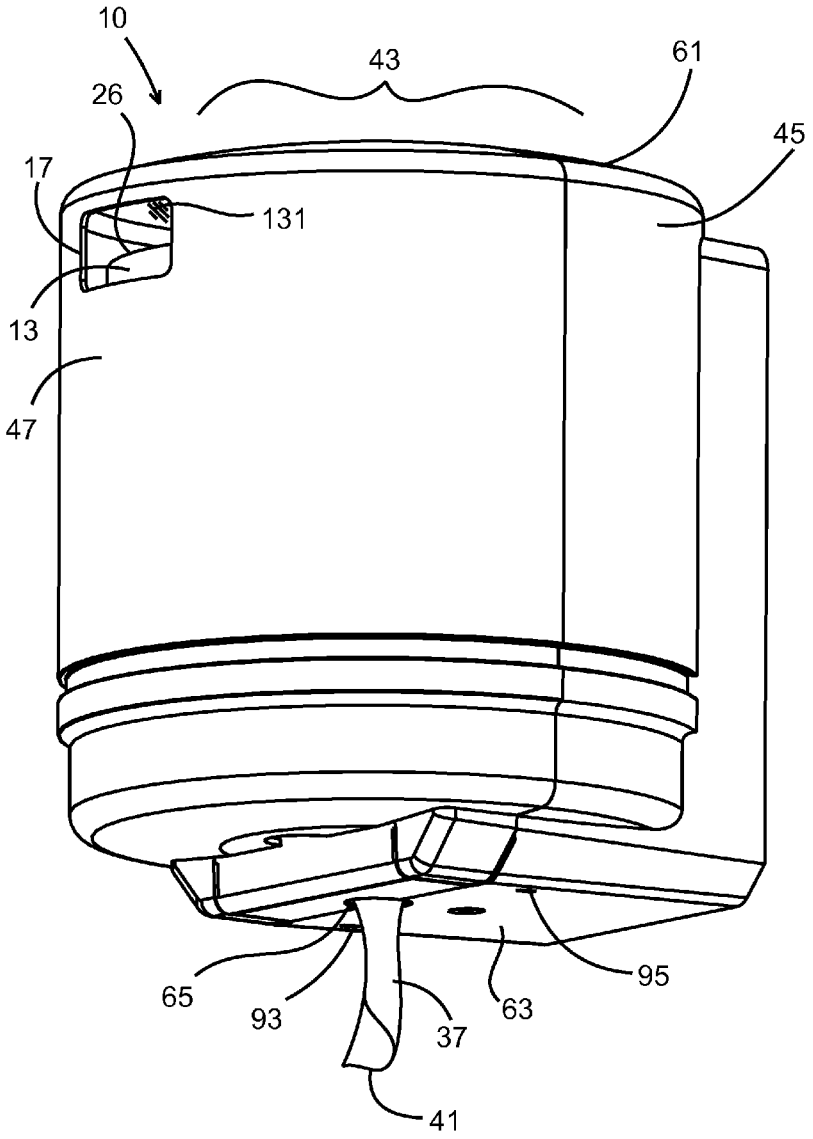
FIG. 1 is a perspective view of an exemplary low-material-indicating center pull dispenser in accordance with the invention.

FIGS. 1-5, 7-13 and 16-19 illustrate a first embodiment of a low-material-indicating center pull dispenser 10 capable of dispensing a web of material 11 from a center pull roll 13. Other embodiments of a low-material-indicating center pull dispenser 10*a*, 10*b*, 10*c* are illustrated in FIGS. 14-15 and 20-21 and are described below. (Center pull dispensers 10-10*c* are also referred to herein simply as "dispensers.") For convenience and brevity, like reference numbers are used to describe like components of dispenses 10-10*c*. Each dispenser 10-10*c* provides information about the amount of material 11 remaining on a center pull roll 13 in the dispenser 10-10*c* so that the attendant can replace the partially-depleted center pull roll 13 with a new center pull roll before the center pull dispenser 10-10*c* runs out of material 11.

In the examples, low-material indicator structure comprising a roll support platform 15 and center pull roll viewing structure permitting viewing of a center pull roll when loaded therein are provided. Center pull roll viewing structure as used herein is intended to have an expansive meaning which includes any structure or structures capable of permitting a person to observe the position of the center pull roll 13 in the dispenser.

An example of center pull roll viewing structure may include one or more window 17. A further example of center pull roll viewing structure may include the dispenser 10 housing 43, or a portion 48 of the housing, if made of a light-transmissive material permitting viewing of a center pull roll 13 when loaded in the dispenser 10.

The roll support platform 15 enables a center pull roll 13 of material 11 to change position. The change of center pull roll 13 position represents information indicative that the center pull roll 13 is approaching depletion and that the center pull dispenser 10 is in a low-material state. A low-material state means or refers to the state in which dispenser 10 approaches being out of material 11. Conversely, if a change of position has not occurred, that would provide information indicating that sufficient material 11 remains on the center pull roll 13 and that the center pull dispenser 10 is not in a low-material state.

Exemplary dispenser 10 and roll support platform 15 take advantage of the recognition that a center pull roll 13 is unwound from the inside out and that consumption of the inner portions of the center pull roll 13 can be utilized to cause the center pull roll to change position on the exemplary roll support platform 15. In embodiments, window 17 enables an attendant to see that the center pull roll 13 has changed position without any requirement for costly or complex paper followers, linkages and other complex low-material indicators. The change of center pull roll 13 position prompts the attendant to load the dispenser 10 with a new center pull roll 13.

Referring to FIGS. 1, 5-6 and 16-19, an exemplary center pull roll 13 capable of being dispensed from dispenser 10 is shown. In the example, center pull roll 13 is a coreless roll with an inner periphery 19 and an outer periphery 21. Center pull rolls, like center pull roll 13, are sometimes referred to as coreless rolls because they lack a core on which the material ills wound. Center pull roll 13 has a center axis 23 and top and bottom surfaces 25, 27 and top and bottom edges 26, 28. The top and bottom surfaces 25, 27 are formed by the coiled web of material 11 wound into the center pull roll 13. Bottom surface 27 has a surface area which can be demarcated, as indicated by the exemplary phantom line 30 in FIG. 6, into inner and outer regions 29, 31 which are generally concentric about center axis 23. A center pull roll 13 may not form a perfect cylinder and could be in the form of a rectangular cylinder resulting in the inner and outer regions 29, 31 being less than completely concentric. Irrespective of the specific shape of the center pull roll 13, the web of material 11 is unwound from the inner region 29 before being unwound from the outer region 31. The precise boundary of the center pull roll 13 inner and outer regions 29, 31 represented by phantom line 30 is defined by the size and configuration of the roll support platform 15 inward and lower outward portions 33, 35 which support the center pull roll 13. The boundary defining regions 29, 31 represented by phantom line 30 can vary depending on the configuration of the roll support platform 15 inward and lower outward portions 33, 35.

In the example, the material 11 wound to form center pull roll 13 is in the form of a continuous web, that is a continuous strip of material 11, which is divided into discrete sheets 37 by spaced-apart, transverse lines of perforations 39 along the edges of each sheet 37. Perforation lines 39 in material 11 may be omitted from the web of material 11 if other means of separating the material 11 into separate sheets 37 is provided. For example, dispenser 10 could be provided with a cutter (not shown) to separate the material 11 into separate sheets 37.

The material 11 is typically rolled onto itself and then wound into the center pull roll 13 producing the coiled center pull roll top and bottom surfaces 25, 27 and so that the leading end 41, or tail, extends out from the center pull roll inner periphery 19 and out of the dispenser 10. The material 11 is unwound from the inner periphery 19 of the center pull roll 13 by user pulling on the leading end 41.

Referring now to FIGS. 1-5, 7-13 and 16-19, exemplary dispenser 10 preferably includes a housing 43 comprising a housing rear portion 45 and a front housing cover 47 which can be opened and closed to permit access to housing interior 49. In combination, the rear portion 45 and housing cover 47 define a generally cylindrically-shaped housing 43 with a generally cylindrically-shaped interior 49. Such housing 43 structure and geometry, while not required, are preferred because housing 43 efficiently accommodates the generally cylindrically-shaped form in which most commercially-available center pull paper towel rolls 13 are provided as illustrated for example in FIGS. 5-6 and 16-19.

Figure 3:
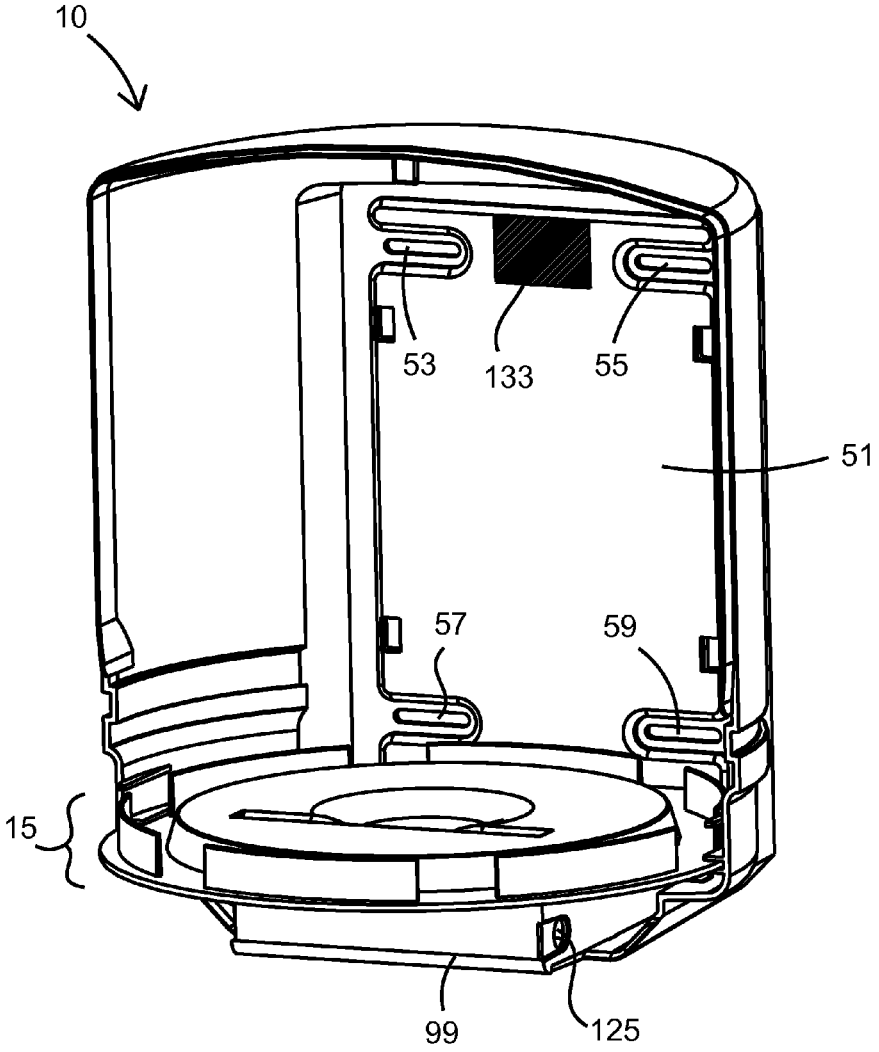
FIG. 3 is a perspective view of the dispenser of FIG. 1 with the housing cover removed.
Figure 4:
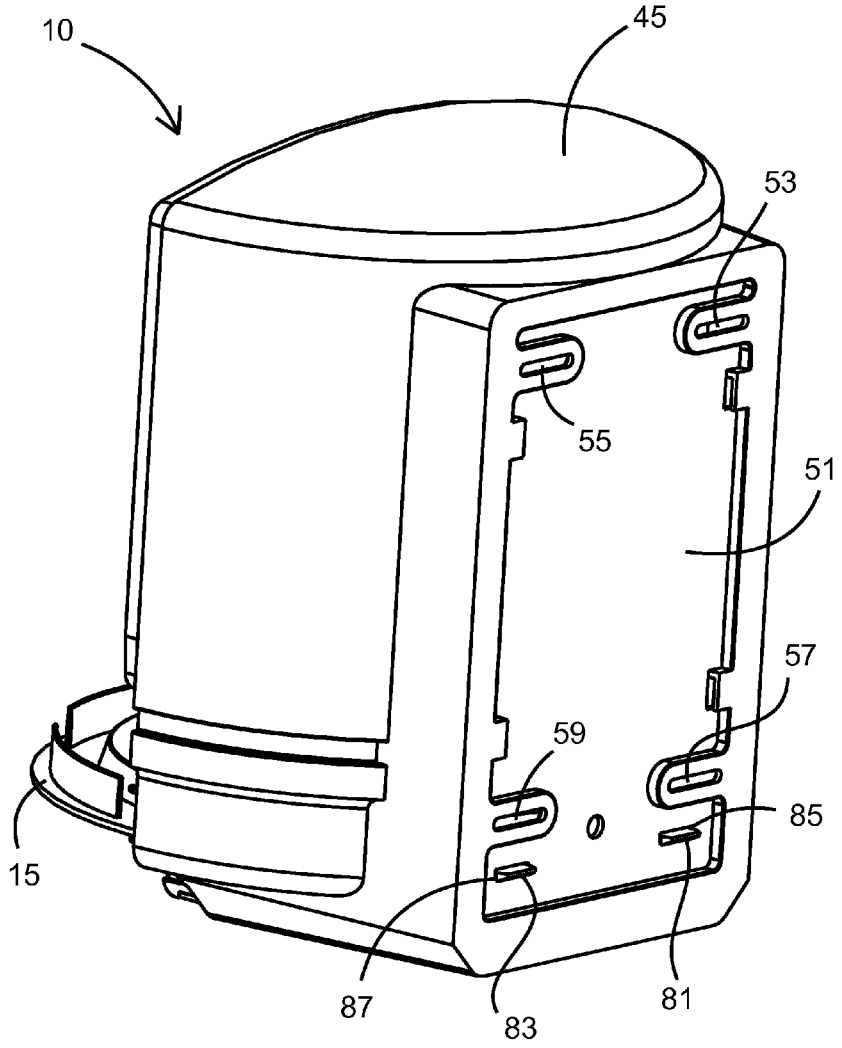
FIG. 4 is a rear side perspective view of the dispenser of FIG. 1 with the housing cover removed.

Housing rear portion 45 is provided to support dispenser 10 for use. In the example, housing rear portion 45 includes a generally flat rear wall 51 which is adapted to be mounted to a support surface (not shown), such as a wall surface in a washroom or a column adjacent an automobile filling station gasoline pump. As best shown in FIGS. 3-4, openings 53, 55, 57, 59 are provided in rear wall 51 to receive fasteners (not shown), such as screws or the like, which may then be secured to the support surface to support dispenser 10. It will be readily appreciated that dispenser 10 may be supported along a support surface by other types of mounting means known to those of skill in the art. For example, a mounting plate (not shown) secured to a wall, pole or other support surface and designed to mate with housing rear wall 51 may be utilized.

Exemplary housing includes a top and a bottom 61, 63 formed by the closure of the housing cover 47 against rear portion 45. Bottom 63 may include opening 65 through which the web of material 11 exits dispenser 10. It is envisioned that opening 65 could be in other locations such as the top 61 of the housing 43 in embodiments in which the material 11 is pulled up from the center pull roll 13.

Figure 5:
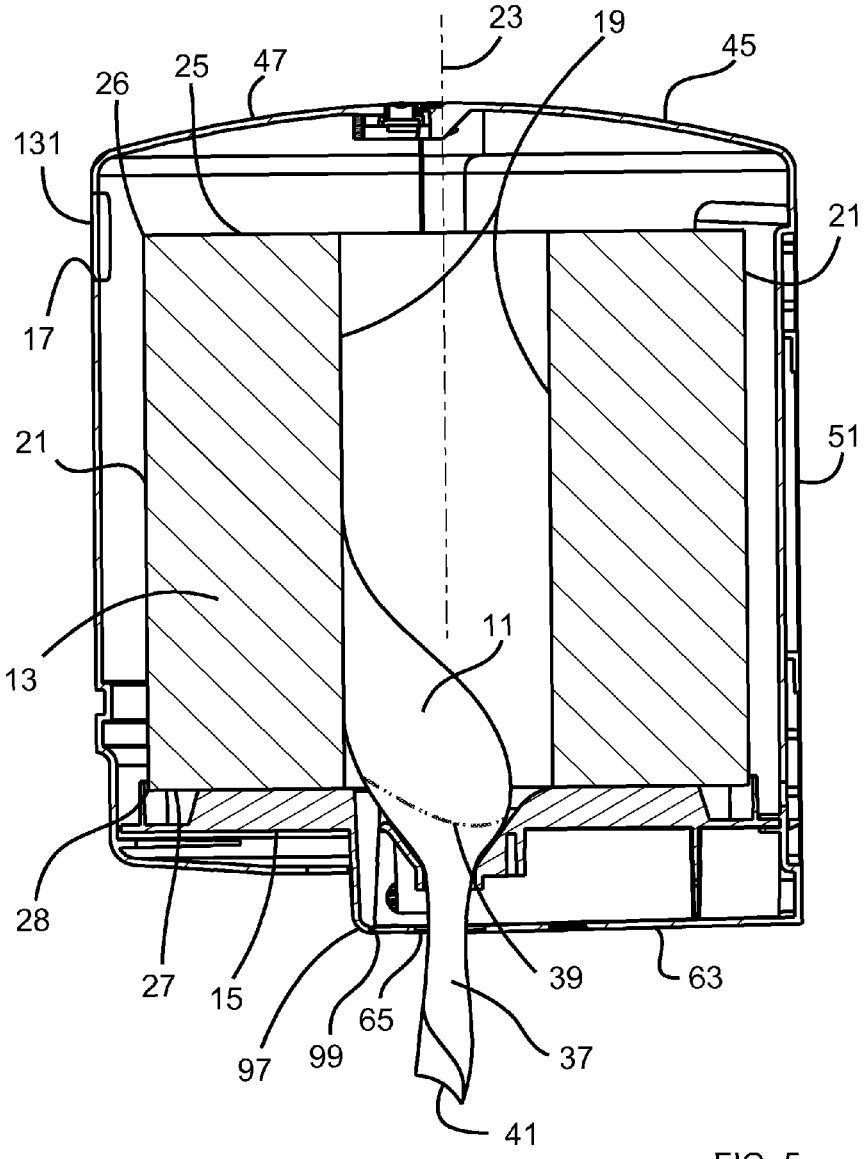
FIG. 5 is a section view taken along section 5-5 of FIG. 1-A showing an exemplary center pull roll in the dispenser.

Exemplary roll support platform 15 will now be described in connection with FIGS. 2-5, 7-11 and 16-19. Exemplary roll support platform 15 has top and bottom sides 67, 69 and is bounded by edge 71. Front, rear and side walls 73, 75, 77, 79 depend from bottom side 69 and provide strength and rigidity for roll support platform 15. As illustrated in FIGS. 1-2, 4 and 7-11, exemplary roll support platform 15 may be attached to housing rear portion 45 by "snap fit" engagement of catches 81, 83 on platform 15 with openings 85, 87 on rear portion 45 and by engagement of catches 89, 91 with openings 93, 95 on dispenser bottom 63. Roll support platform 15 rear and side walls 75, 77, 79 rest on housing bottom 63 of housing rear portion 45 to provide additional support for roll support platform 15. Referring to FIG. 5, roll support platform 15 front wall 73 rear edge 97 abuts housing rear portion 45 front edge 99 to provide further support for roll support platform 15 and to enclose housing 43. In the illustrated embodiments, slot 101 in roll support platform 15 results from formation of roll support platform 15 front wall 73 during manufacture.

Referring to the examples of FIGS. 2-3, 5, 7-11 and 16-19, roll support platform 15 inward portion 33 and lower outward portion 35 are along roll support platform 15 top side 67. Exemplary inward portion 33 of roll support platform 15 provides a surface on which center pull roll 13 inner region 29 rests. Roll support platform inward portion 33 may lie in a plane 103. Roll support platform lower outward portion 35 provides a surface on which center pull roll 13 outer region 31 rests once the center pull roll 13 drops, or falls, down onto the outward portion 35. Lower outward portion 35 of roll support platform 15 may lie in a plane 105 which is lower than plane 103 for the purposes described below. It is not required that roll support platform inward and lower outward portions 33, 35 are planar because non-planar inward and lower outward portions 33, 35 can be utilized consistent with the invention.

In the example, roll support platform inward portion 33 defines central dispensing opening 107 at a junction with a dispenser element 109 inlet end. Dispenser element 109 depends down from roll support platform 15 bottom side 69.

Roll support platform 15 may be a single component as illustrated or may comprise a plural-part component. For example, a roll support platform 15 could comprise a conventional shelf on which a separate part including inward and lower outward portions 33, 35 could be placed to support the center pull roll 13.

As illustrated in FIGS. 5, 7-10 and 16-19, exemplary dispenser element 109 is preferably a generally conically-shaped nozzle having a wide inlet end in communication with central dispensing opening 107 and narrowing to an outlet end including a wall 111, which is preferable annular, that defines an outlet orifice 113. Dispenser element 109 inner surface 115 defines a passageway between central dispensing opening 107 and outlet orifice 113 through which material 11 is directed out of dispenser interior 49. Surface 115 preferably has a curved conical configuration at the junction of central dispensing opening 107 and roll support platform inward portion 33 to provide a smooth transition from the roll support platform inward portion 33 to the dispenser element 109 to prevent material 11 from tearing as the material 11 is unwound from the center pull roll inner periphery 19 in a circular pattern. Further, surface 115 is preferably smooth and of a low-friction material so that the material 11 moves easily over the surface 115 without tearing or snagging and causing minimal or no wear along dispenser element 109 surface 115.

As illustrated in FIG. 5, wall 111 may be a friction-providing surface which contacts material 11 unwound from center pull roll 13, passed through dispenser element 109 and out of dispenser 10 through outlet orifice 113. Material 11 has a cross-sectional area when compressed by wall 111 as the material 11 exits dispenser element 109 through outlet orifice 113. Wall 111 is sized so that the material 11 cross-sectional area can pass through outlet orifice 113 with friction force, or drag, applied to the material 11 by movement against wall 111 during user pulling on the material leading end 41. Friction between wall 111 and material 11 during user pulling causes a single sheet 37 of material 11 to separate from the adjacent sheet along the perforation line 39.

Figure 9:
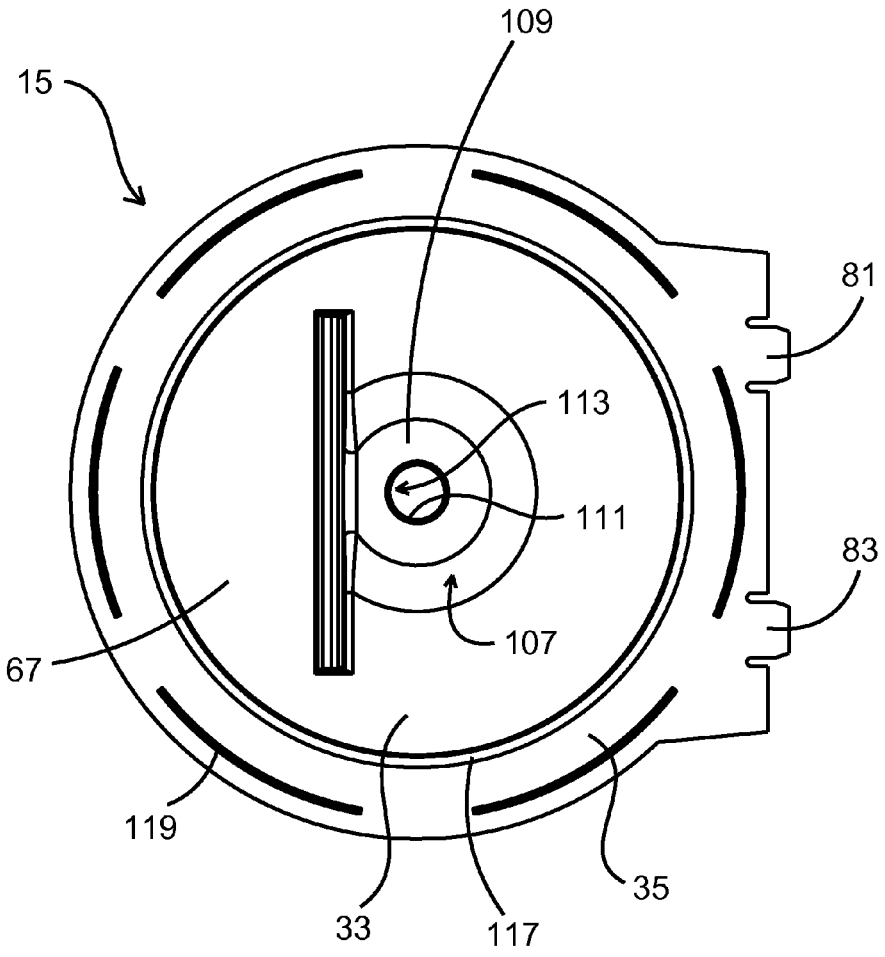
FIG. 9 is a top side plan view of the exemplary roll support platform from the dispenser of FIG. 1.
Figure 10:
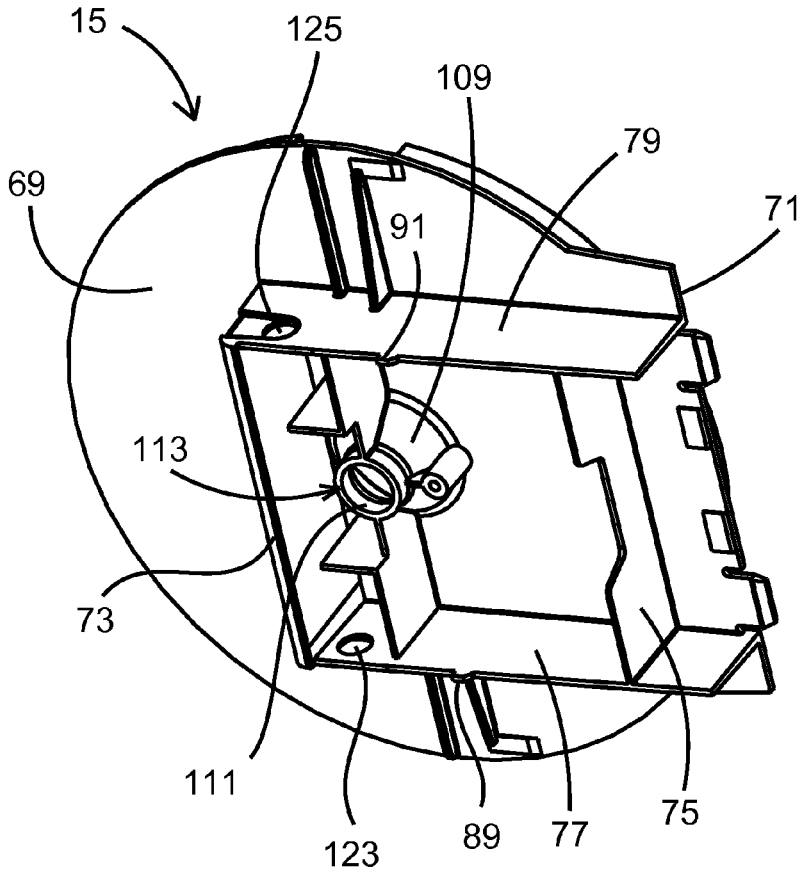
FIG. 10 is a bottom side perspective view of the exemplary roll support platform from the dispenser of FIG. 1.
Figure 11:
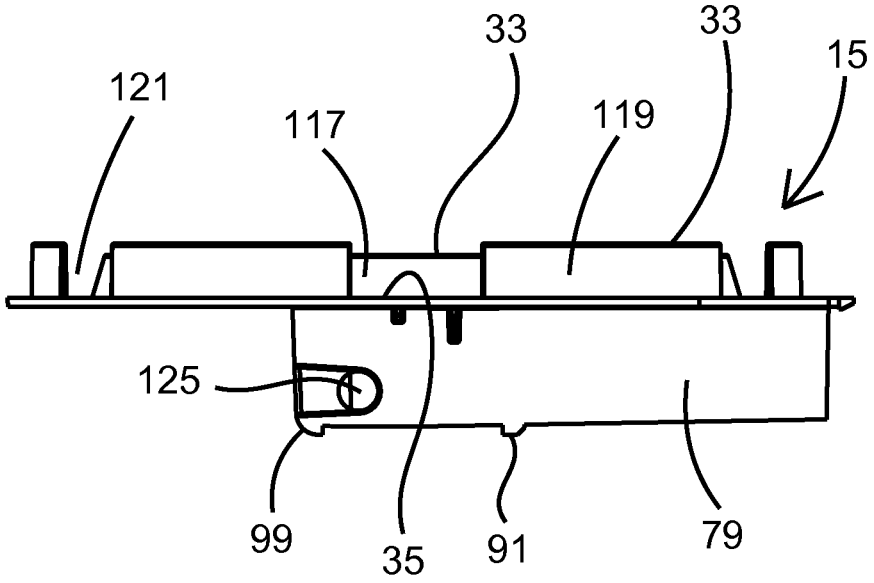
FIG. 11 is a side elevation view of the exemplary roll support platform from the dispenser of FIG. 1.

Referring to FIG. 9, central dispensing opening 107 is preferably in the center of roll support platform 15 inward portion 33 and is further centrally disposed within lower outward portion 35 of roll support platform 15. Preferably, inward portion 33 and lower outward portion 35 of roll support platform 15 are concentric. As illustrated in FIGS. 5 and 16-19, it is preferred that there is axial alignment of central dispensing opening 107, dispenser element 109 and outlet orifice 113. Center pull roll center axis 23 of a center pull roll 13 resting on roll support platform inward portion 33 is also in axial alignment with parts 107, 109 and 113 in the example. The exemplary axial alignment facilitates unwinding of material 11 in a circular path (i.e., a 360° path) from the center pull roll 13 inner periphery 19.

As illustrated in FIGS. 5 and 16-19, the outlet end of dispenser element 107 and the outlet orifice 113 may be positioned within housing bottom 63 proximate to, and axially aligned with, bottom opening 65. Housing bottom 63 protects outlet orifice 113 from contact by contaminants or water which could interfere with the ability of wall 111 to provide sufficient frictional force, or drag, as the web of material 11 passes through wall 111 and exits outlet orifice 113.

Wall 111 defining outlet orifice 113 is but one example of a friction-providing surface for use in the dispenser 10 of the present invention. Wall 111 could define a rectangular, or other geometric shape, orifice 113. Wall 111 defining outlet orifice 113 may be sized and configured for material 11 other than paper webs, for example webs made of cloth fiber, or webs made of blends of cloth and paper fiber. By way of further example, various inserts could be inserted into wall 111 to modify the cross-sectional area of orifice 113 to accommodate material 11 of varying thicknesses.

Figure 20:
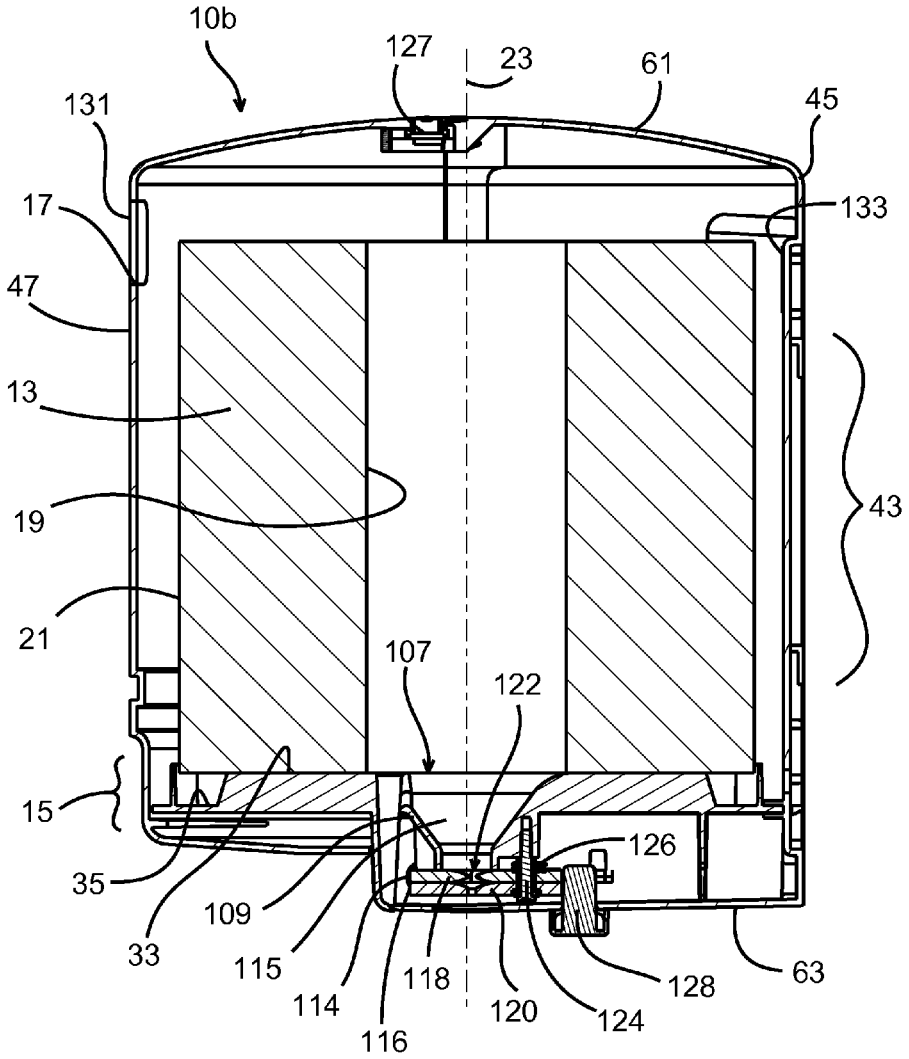
FIG. 20 is a section view taken along a section such as section 5-5 of FIG. 1 of a further dispenser embodiment with the center pull roll in the first position indicative that sufficient material is on the center pull roll and including self-adjusting restriction elements for applying a friction force against the web of material.

Other types of friction-providing surfaces could be provided separately or in combination with wall 111. Referring to FIG. 20 and by way of example only, the friction-providing surface could comprise the self-adjusting force-applying means of commonly-owned U.S. Pat. No. 6,299,035 (Haen et al.) which is incorporated herein by reference. Referring to FIG. 20, there is illustrated a section view of a dispenser embodiment **10*b* which is identical to dispenser 10 except that wall 111 provides minimal friction against material 11 and the dispenser 10*b* includes force-applying means comprising first and second restriction elements 114, 116 mounted with respect to dispenser element 109 outlet orifice 113. The description of dispenser 10 is incorporated by reference with respect to dispenser 10*b***.

The restriction elements 114, 116 include jaw portions 118, 120 which form a passageway 122 through which material 11 is pulled between the jaw portions 118, 120. Pin 124 coaxially secures restriction elements 114, 116 to dispenser **10*b* along a pivot axis with restriction element 114 positioned above restriction element 116 for smooth pivoting displacement of restriction elements 114, 116** back and forth in an overlapping, scissors-like manner.

A biasing device, such as a torsion spring 126 positioned over pin 124, biases restriction elements 114, 116 to pivot together so that jaw portions 118, 120 impart a frictional force on the material 11 as material 11 is pulled between restriction elements 114, 116. A knob 128 can be rotated by an attendant to act on restriction elements 114, 116 to spread jaw portions 118, 120 so that material 11 can be positioned between jaw portions 118, 120 during loading of dispenser **10*b* with a center pull roll 13**.

As described in the '035 patent, restriction elements 114, 116 self adjust so that the jaw portions 118, 120 apply force, or drag, against the material 11 responsive to the unique effective cross-sectional area of the material 11 passing therethrough, thereby imparting sufficient frictional force to permit separation of a single sheet 37 along a perforation line 39 outside the dispenser **10*b* as described in the '035 patent. Such force-applying means would enable the dispenser 10*b* to operate with a broad range of material 11** types such as 1 ply ultra light towel, 1 ply soft towel and 1 ply light kraft towel.

Figure 6:
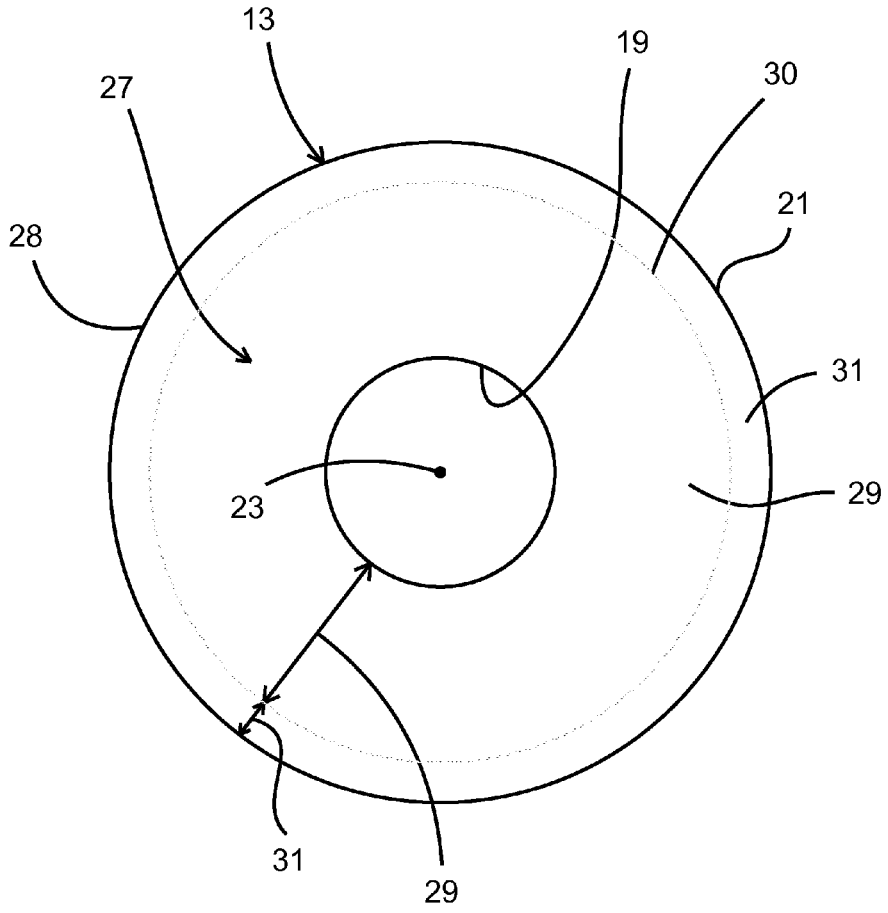
FIG. 6 is a bottom plan view of the coiled bottom surface of the exemplary center pull roll of FIG. 5.
Figure 7:
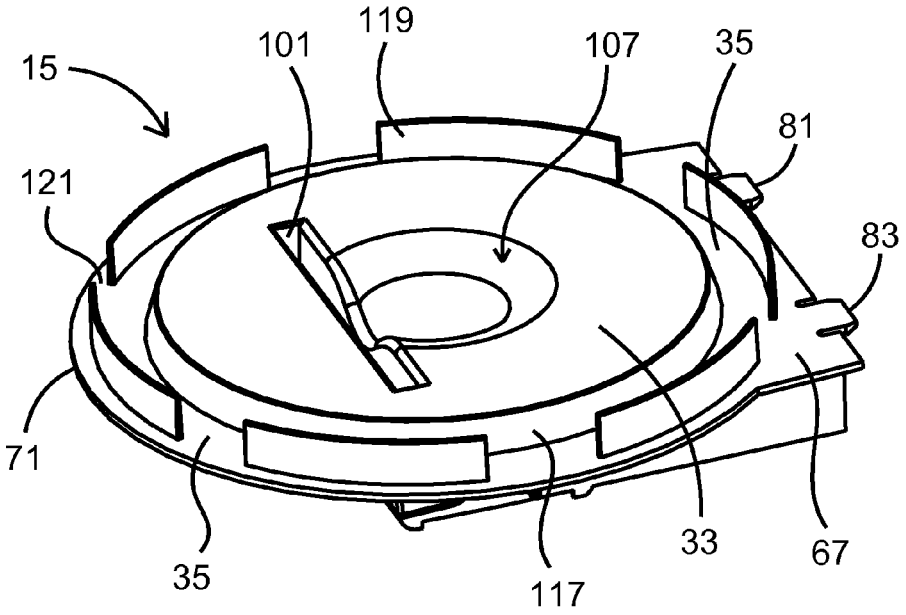
FIG. 7 is a perspective view of an exemplary roll support platform from the dispenser of FIG. 1.
Figure 8:
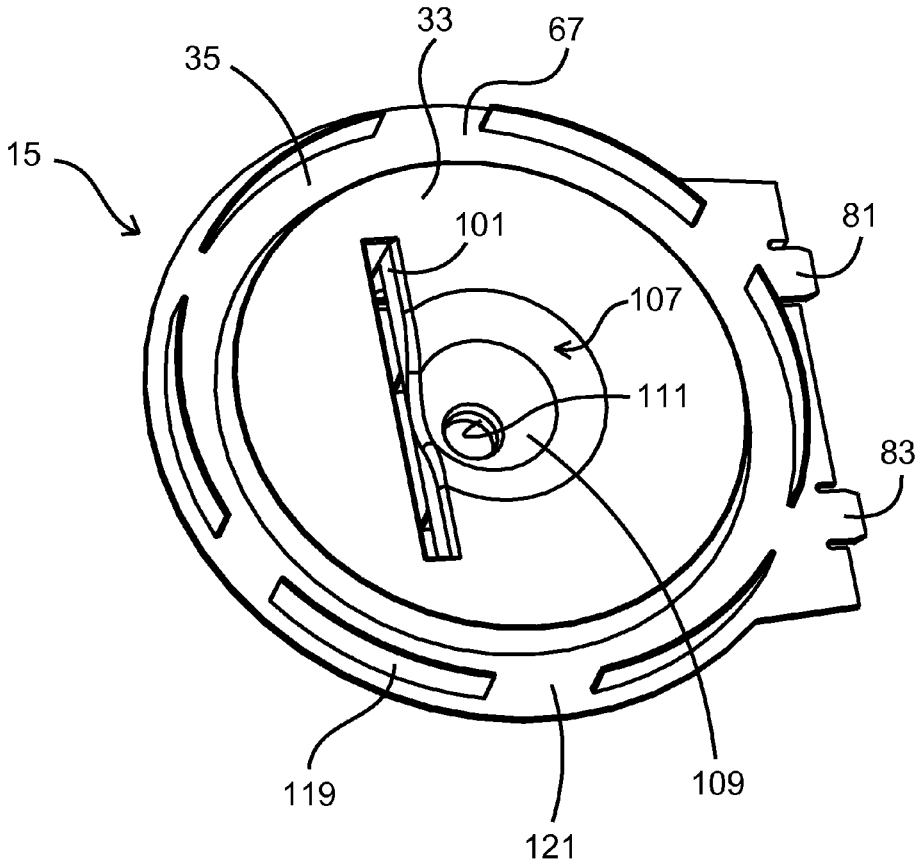
FIG. 8 is a further perspective view of the exemplary roll support platform from the dispenser of FIG. 1.

The structure of exemplary roll support platform 15 inward and lower outward portions 33, 35 and related structure will now be described in connection with FIGS. 3-11 and 16-19. Exemplary roll support platform 15 inward portion 33 is preferably circular and has a surface that lies in plane 103 and lower outward portion 35 is preferably an annular or ring shaped surface concentric with inward portion 33 that lies in a plane 105 which is lower than plane 103. The preferred inward and lower outward portions 33, 35 of roll support platform 15 correspond respectively to the generally concentric inner and outer regions 29, 31 of the coiled roll bottom surface 27. The boundary between inner and outer regions 29, 31 represented by phantom line 30 in FIG. 6 is determined by the periphery of roll support platform inward portion 15 in the example.

Figure 16:
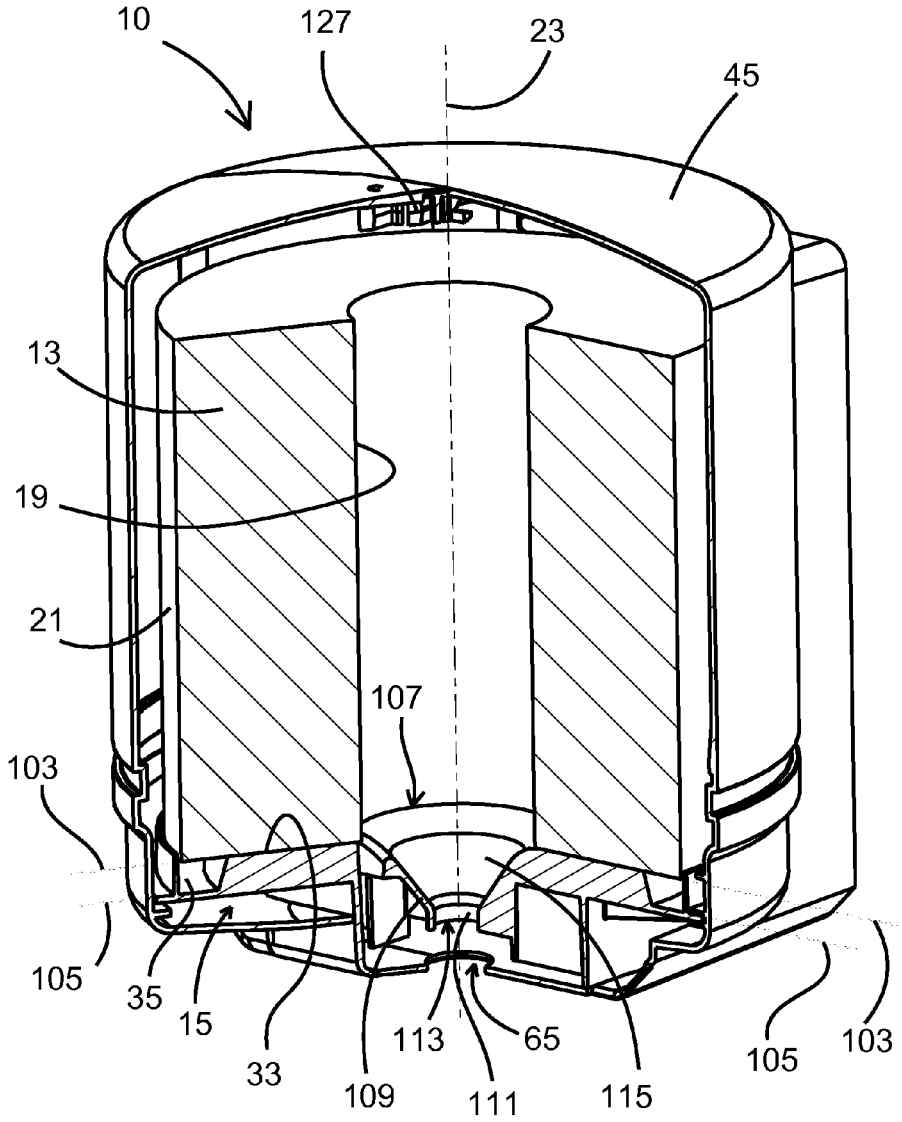
FIG. 16 is a perspective view of the dispenser of FIG. 1 with portions cut away to show certain dispenser internal components and a center pull roll in the first position indicative that sufficient material is on the center pull roll.
Figure 18:
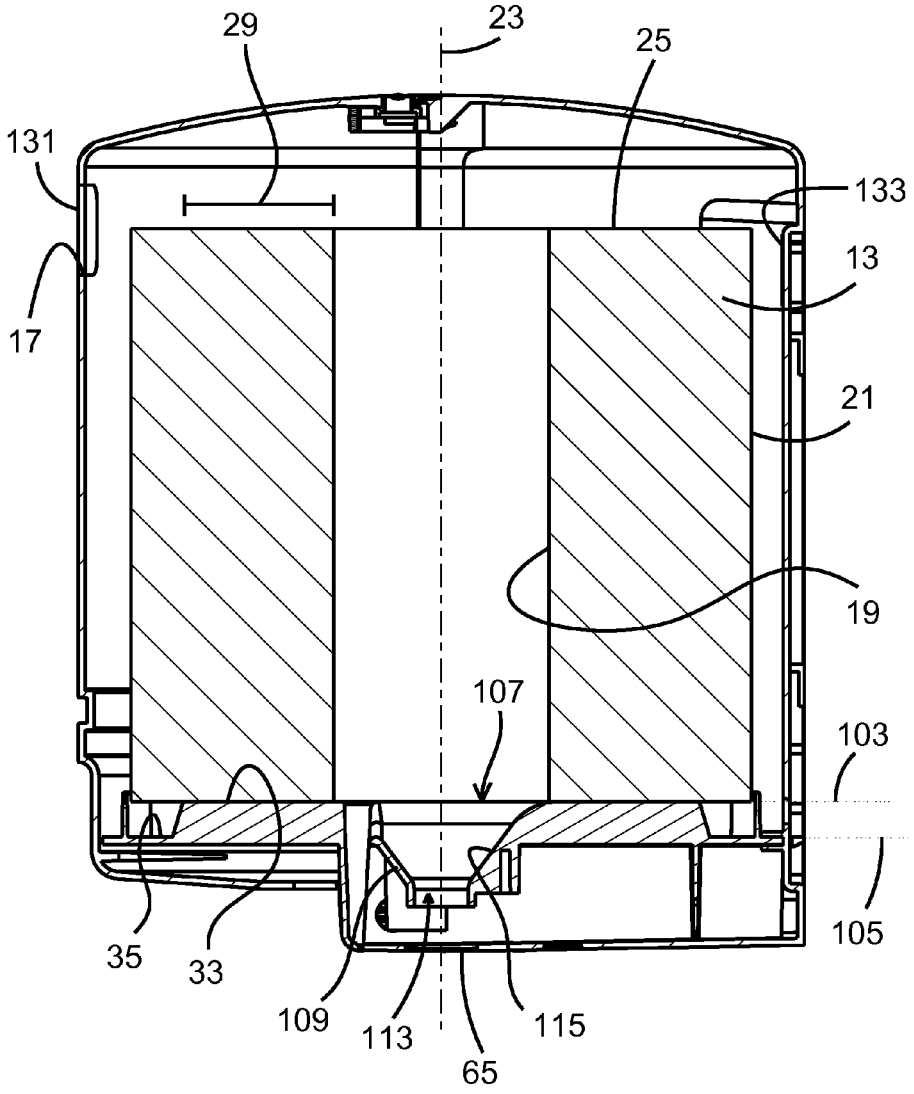
FIG. 18 is a section view taken along section 18-18 of FIG. 12 showing a center pull roll in the first position indicative that sufficient material is on the center pull roll.

Roll support platform inward portion 33 has a surface area which is less than the area of the roll bottom surface 27 so that the center pull roll bottom outer region 31 extends radially outward beyond the roll support inward portion 33 and overhangs the lower outward portion 35 before the center pull roll 13 drops down onto the lower outward portion 35 of the roll support platform 15 as illustrated in FIGS. 5, 16 and 18.

In the example, lower outward portion 35 is positioned around and below inward portion 33 and is lowered with respect to inward portion 33. A partially-depleted center pull roll 13 outer region 31 rests on roll support platform lower outward portion 35 once center pull roll 13 inner region 29 is depleted and the center pull roll 13 drops onto the lower outward portion 35.

In the example, the position of the center pull roll 13 on the roll support platform 15 inward portion 33 is referred to herein as a "first position." The first position of center pull roll 13 is indicative that the center pull roll 13 is in a state or condition in which sufficient material 11 remains on center pull roll 13 and that a new center pull roll 13 does not need to be loaded in the dispenser 10. The first position is a full-roll-indicating position of the center pull roll 13. The first position of the center pull roll 13 is illustrated in FIGS. 5, 12, 16 and 18.

Figure 13:
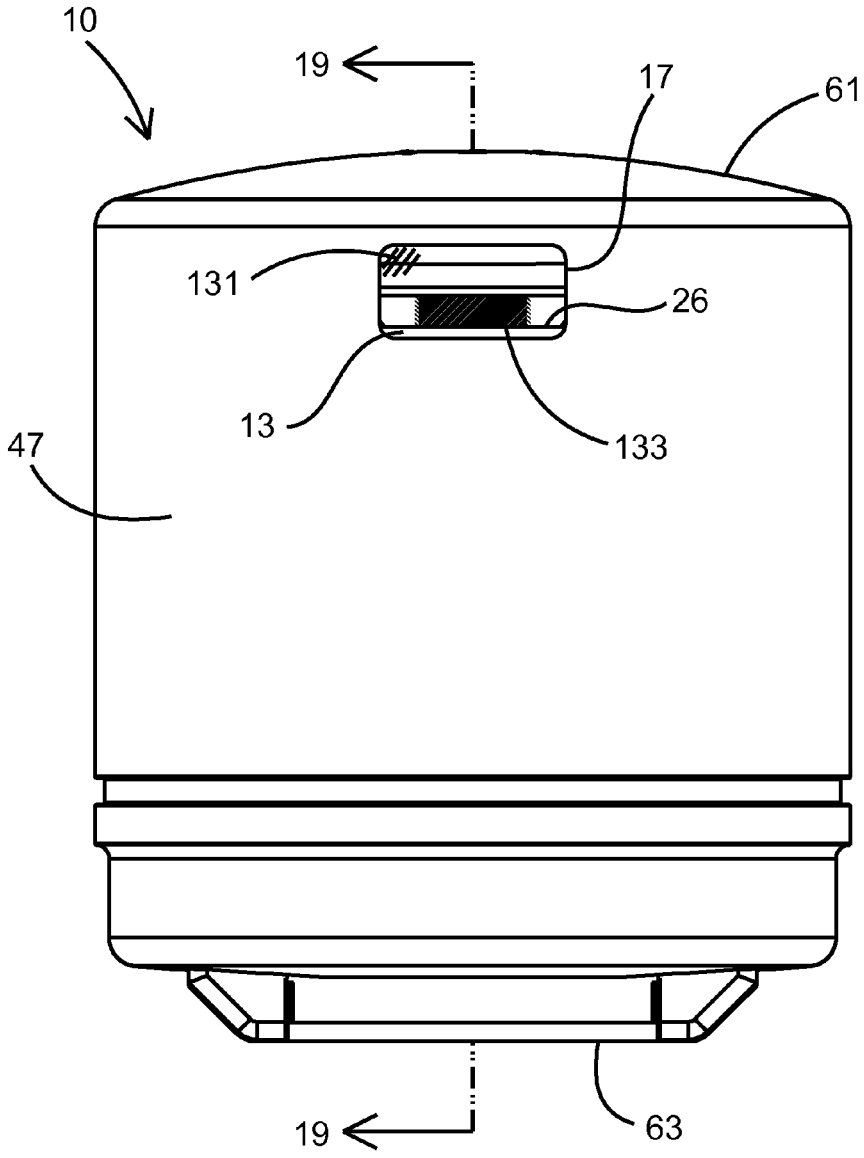
FIG. 13 is a front elevation view of the dispenser of FIG. 12 with the housing cover closed and the center pull roll in a second position indicative that the dispenser is in a low-material state.
Figure 17:
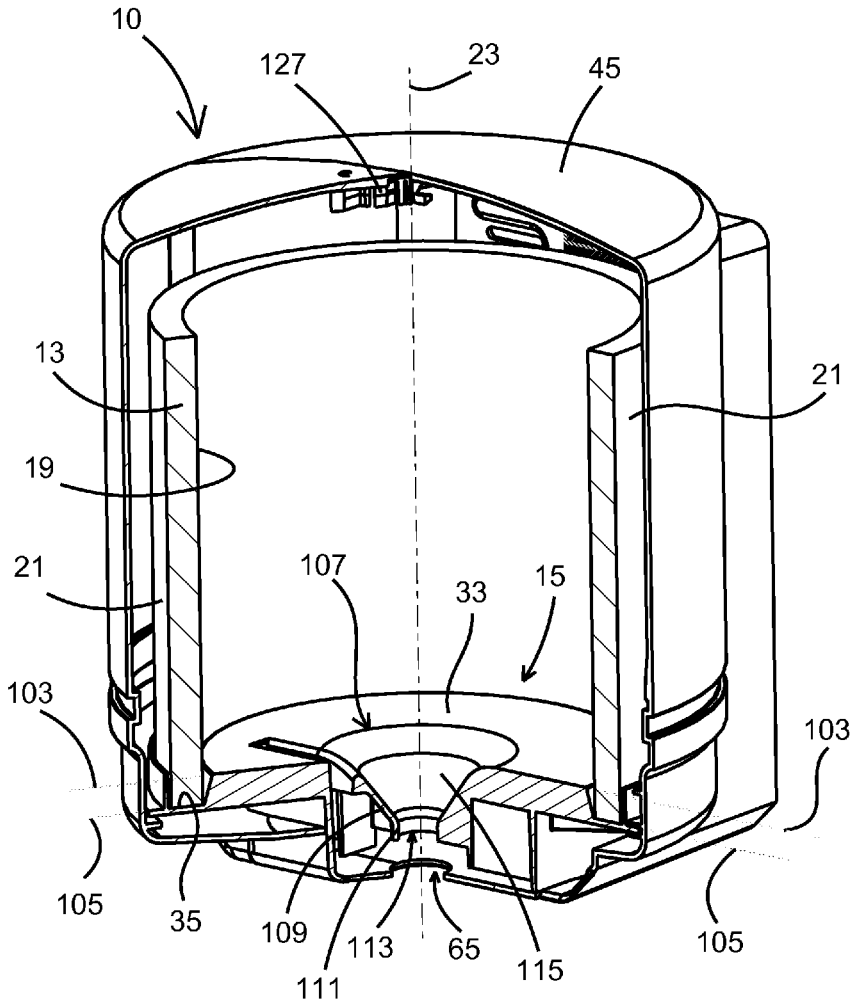
FIG. 17 is a perspective view of the dispenser of FIG. 16 with portions cut away to show certain dispenser internal components and the center pull roll in the second position indicative that the dispenser is in the low-material state.
Figure 19:
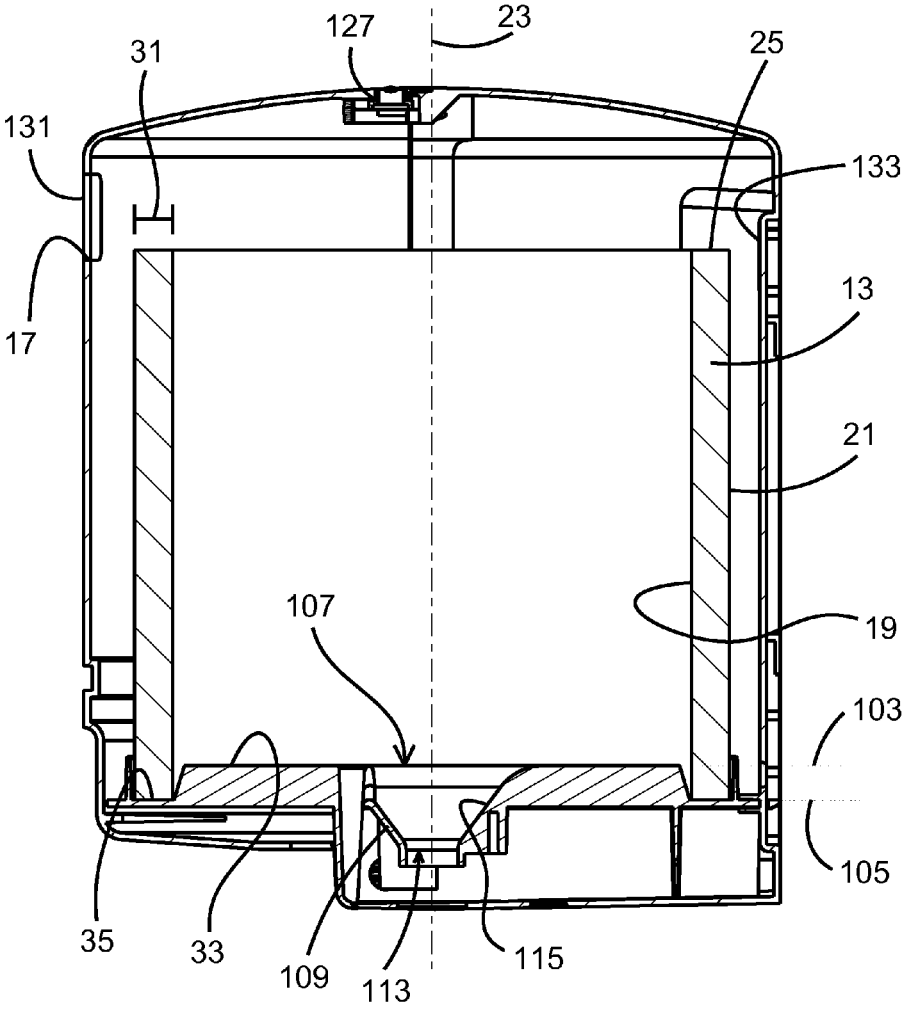
FIG. 19 is a section view taken along a section 19-19 of FIG. 13 showing the center pull roll in the second position indicative that sufficient material is on the center pull roll.

Also in the example, the position of the center pull roll 13 on the roll support platform lower outward portion 35 after the center pull roll 13 has changed position by dropping down to the lower outward portion 35 is referred to herein as a "second position." The second position of the center pull roll 13 is indicative that the center pull roll 13 is in a state or condition in which insufficient material 11 remains on center pull roll 13 and that a new center pull roll 13 should be promptly loaded in the dispenser 10. The second position is indicative to an attendant that the dispenser is in a low-material state. The second position is a depleted-roll-indicating position of the center pull roll 13. The second position of the center pull roll 13 is illustrated in FIGS. 13, 17 and 19.

In the example, center pull roll 13 changes position and moves from the first position to the second position simply by the force of gravity. No mechanical apparatus are required to move the center pull roll 13 from the first position to the second position. The center pull roll 13 may be at other positions intermediate to the first and second positions as the material 11 is unwound from the center pull roll 13 and the center pull roll 13 drops down toward the lower outward portion 35 of roll support platform 15.

Referring to FIGS. 5, 7-9, 11 and 16-19, an upright wall or ramp 117 vertically spaces the roll support platform 15 inward portion 33 which preferably lies in plane 103 above the lower outward portion 35 which preferably lies in plane 105. The spacing provided by ramp 117 between roll support platform inward and outward portions 33, 35 is preferably sufficient to permit the attendant to quickly determine that center pull roll 13 has dropped from the first position to the second position. By way of example only, a spacing between roll support platform inward and lower outward portions 33, 35 of between about 0.250 to about 1.000 inch would permit sufficient movement of center pull roll 13 to inform the attendant that the dispenser is in the low material state.

The maximum spacing preferably should not exceed an amount that would permit material 11 to be easily unwound from the center pull roll 13 as the material 11 is unwound from the inner periphery 19 and passes over the inward portion 33, particularly when the center pull roll 13 is in the second position. An advantage of this arrangement is that the vertical spacing between the roll support platform inward and lower outward portions 33, 35 can be selected based on the axial length of center pull roll 13 (along axis 23) to thereby accommodate center pull rolls 13 having a range of different axial lengths in housing 43.

As illustrated in FIGS. 5, 7-9, 11 and 16-19, ramp 117 is optionally outwardly tapered. By way of example only, the taper may be an angle of between about 10° to 60° from vertical. If provided, the outward taper of ramp 117 serves to center the center pull roll 13 as it drops down onto the roll support platform lower outward portion 35 and provides a smooth surface over which material 11 can be pulled through central dispensing opening 107 once the center pull roll 13 has dropped down to the lower outward portion 35.

The exemplary roll support platform 15 illustrated in FIGS. 5-11 and 16-19 is but one type of structure which can be provided to facilitate change of position of the center pull roll 13. For example, inward and outward portions 33, 35 need not lie entirely in planes 103, 105. The configuration of roll support platform inward and lower outward portions 33, 35 could be other than concentric and inward and lower outward portions 33, 35 could have configurations such as polygons, rectangles and the like to support center pull roll 13 in the first and, alternatively, second positions.

Roll support platform 15 may include a peripheral upright rim 119 projecting up from platform top side 67. Rim 119 may be continuous or discontinuous with a gap 121 or gaps between rim 119 elements. A gap 121 or gaps in rim 119 are particularly useful to view center pull roll 13 in embodiments in which window 17*a* is proximate the roll support platform 15 as illustrated in the alternative embodiment 10*a* of FIGS. 14-15. The gap 121 or gaps would permit an attendant to look through window 17*a* and to see whether the center pull roll 13 has dropped to the second position and is resting on the outward portion 35 providing an indication of the low-material state. If provided, rim 119 provides a guide which can serve to center the center pull roll 13 as it drops from the first position to the second position.

As illustrated in FIGS. 1-3, 10-11, housing cover 47 is preferably attached to roll support platform side walls 77, 79 by means of hinges comprising inwardly facing male posts (not shown) on housing cover 47 inserted into separate axially aligned female openings 123, 125. The hinges permit movement of housing cover 47 between the closed position of FIG. 1 and the open position of FIG. 2. Opening of housing cover 47 permits an attendant to load a new center pull roll 13 into dispenser 10. A lock mechanism 127 may be secured to housing cover 47 for mating with pin 129 on housing rear portion 45 to prevent unauthorized access to housing interior 49 and a center pull roll 13 therein.

A first embodiment of a window 17 provided in housing cover 47 is illustrated in FIGS. 1, 2 and 12-13. Window 17 permits an attendant to look inside dispenser 10 to determine whether the center pull roll 13 has changed position and is in the first position or the second position. In the embodiment of FIGS. 1, 2 and 12-13, window 17 is located toward the top 61 of the housing 43 so that the attendant can see the top edge 26 of the center pull roll 13.

Window 17 may comprise, or may be covered by, a light-transmissive cover 131. Preferably, cover 131 is made of a light-transmissive transparent or translucent material to permit an attendant to look into the housing interior 49. Cover 131, if provided, prevents contaminants from entering dispenser 10 and prevents a person from inserting a finger or other thing into the dispenser 10.

Considerable variation is possible with respect to the structure of window 17. For example, a window 17 could comprise a plurality of windows. Window 17 could be located on housing rear portion 45 rather than on housing cover 47. Window 17 could be any size and arrangement permitting the center pull roll 13 position to be viewed by an attendant.

Figure 2:
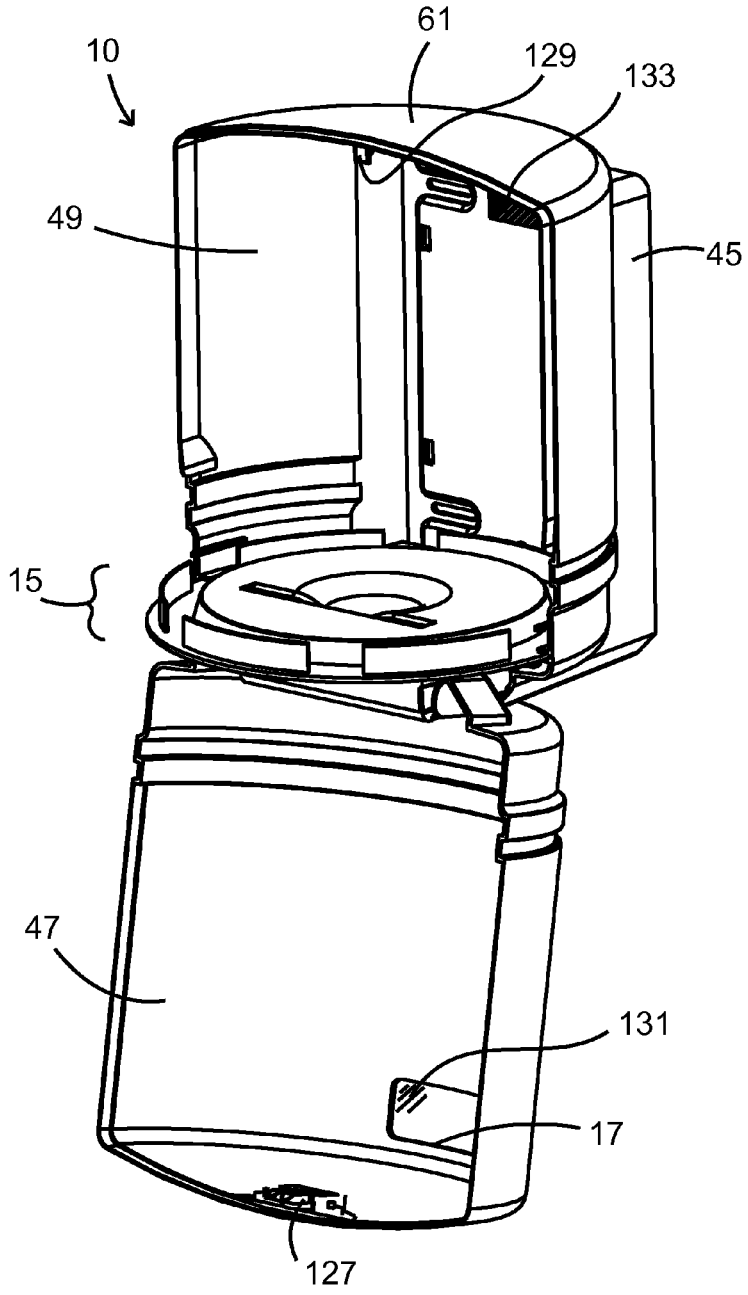
FIG. 2 is a perspective view of the dispenser of FIG. 1 with the housing cover open.
Figure 12:
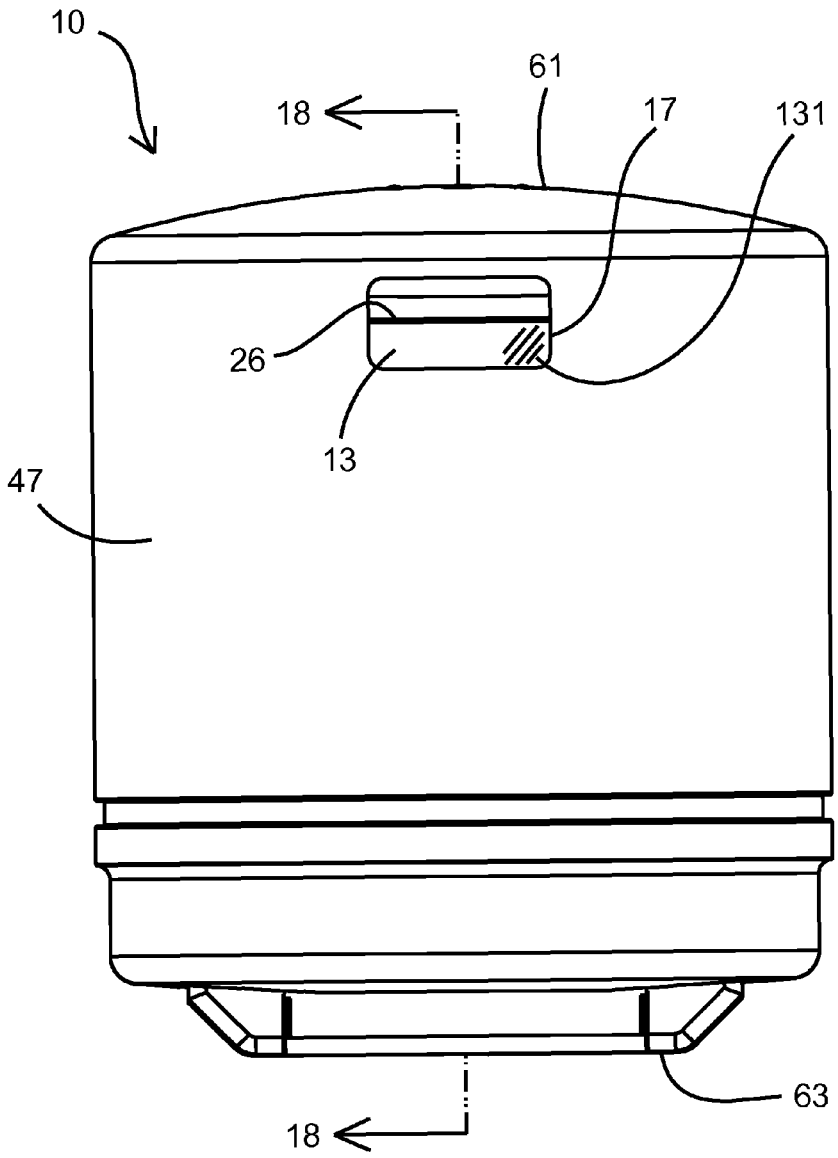
FIG. 12 is a front elevation view of the dispenser of FIG. 1 with the housing cover closed and a center pull roll in a first position indicative that sufficient material is on the center pull roll.

Referring to FIGS. 2-3 and 13, at least one position indicator 133 may be provided to facilitate recognition of the change of center pull roll 13 position of the center pull roll 13 from the first position to the second position. In the example, position indicator 133 comprises indicia. Indicia is intended to have an expansive meaning which means or refers to markings, words or other information. Position indicator 133 may be located on rear wall 51 as illustrated in FIGS. 2-3 and 13. In the example of FIGS. 2-3 and 13, position indicator 133 is a panel affixed to housing rear wall 51 which is of a bright color or a color that contrasts with housing rear wall 51. In the embodiment, position indicator 133 is aligned with window 17 when housing cover 47 is in the closed position of FIGS. 2, 5 and 12. A center pull roll 13 in the first position obstructs, or hides, view of the position indicator 133 through window 17 as illustrated in FIG. 12. The position indicator 133 becomes viewable through window 17 once center pull roll 13 has begun to change position to the second position from the first position as illustrated in FIG. 13. The indicia comprising position indicator 133 serve as a type of "flag" which, once visible, provides an informational signal to the attendant which alerts the attendant that the dispenser 10 is in the low material state.

Figure 21:
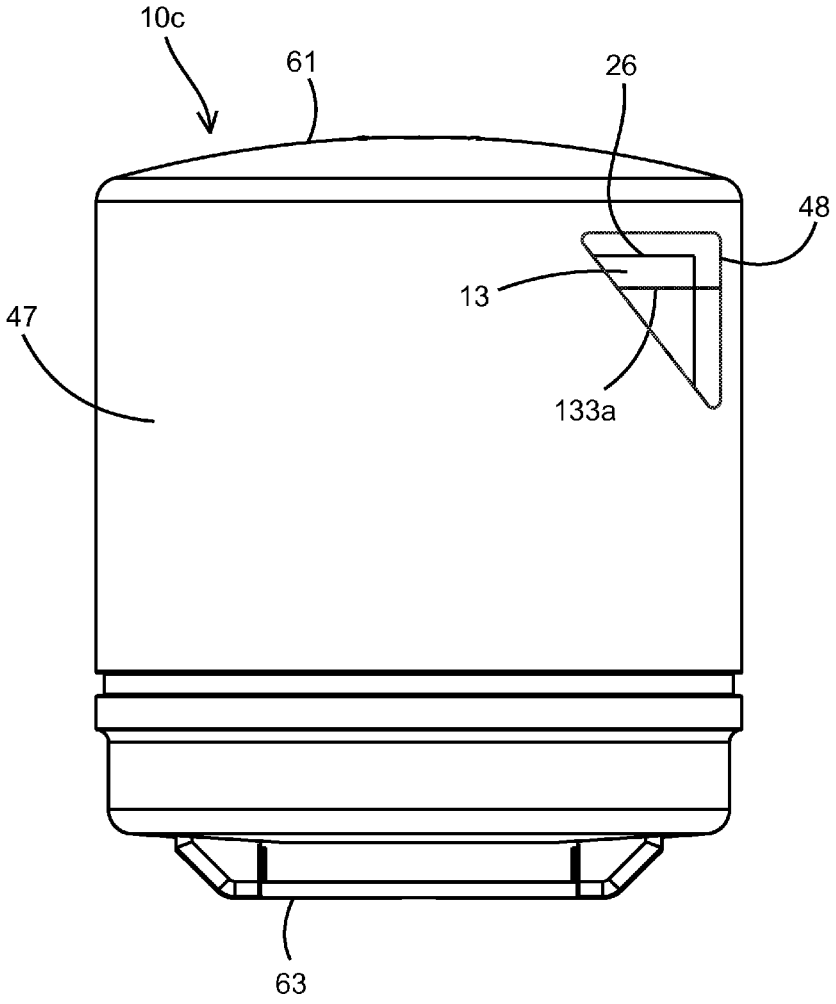
FIG. 21 is a front elevation view of a further dispenser embodiment including a housing having a light-transmissive portion permitting the center pull roll to be viewed through the housing.

Position indicator 133 is but one type of structure which can be provided to assist the attendant to quickly determine whether the center pull roll 13 has changed position indicative of the low-material state. For example, a position indicator 133*a* such as indicia forming one or more horizontal line could be superimposed on housing 43 proximate portion 48 of housing as illustrated in FIG. 21. By way of further example, window 17 and housing cover 47 could be configured to include surfaces which would make movement of the center pull roll 13 readily apparent thereby providing a type of position indicator. An advantage of these types of exemplary position indicators 133, 133*a* is that no moving parts are required, thereby reducing the cost and complexity of dispenser 10.

As illustrated in FIGS. 12 and 13, window 17 may be positioned so that the top edge 26 of center pull roll 13 is viewable both before and after the center pull roll 13 moves to the second position from the first position when looking into the window 17 in a plane generally parallel with the center pull roll top 25. However, window 17 could also be located closer to the housing top 61 above the top edge 26 of center pull roll 13 when the center pull roll 13 is in the second position so that the center pull roll 13 is hidden behind housing cover 47 and cannot be viewed through window 17 when looking into the window 17 in the plane generally parallel with the center pull roll top 25. Inability to view center pull roll 13 would indicate that the dispenser 10 is in the low-material state. If provided, indicator 133 would be viewable when the center pull roll 13 is in the second position.

Figure 14:
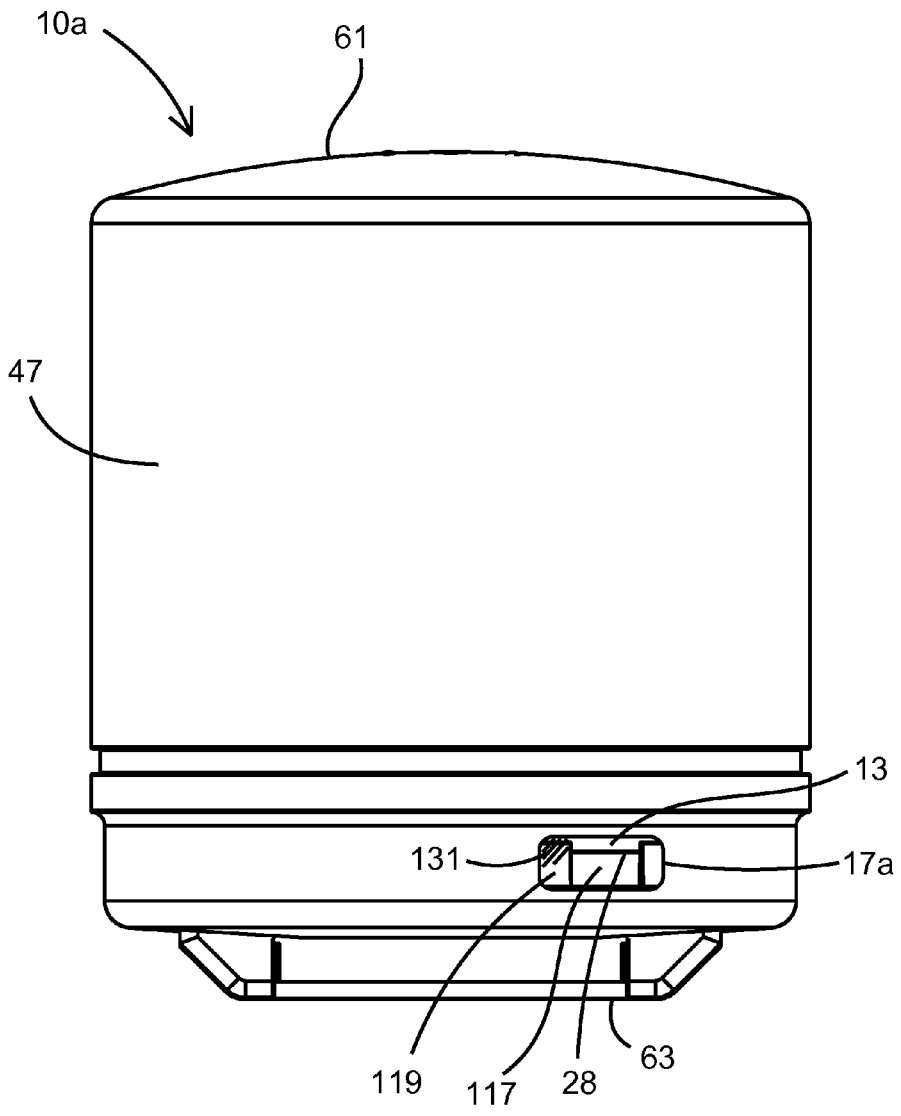
FIG. 14 is a front elevation view of a further dispenser embodiment with the housing cover closed and a center pull roll in a first position indicative that sufficient material is on the center pull roll.
Figure 15:
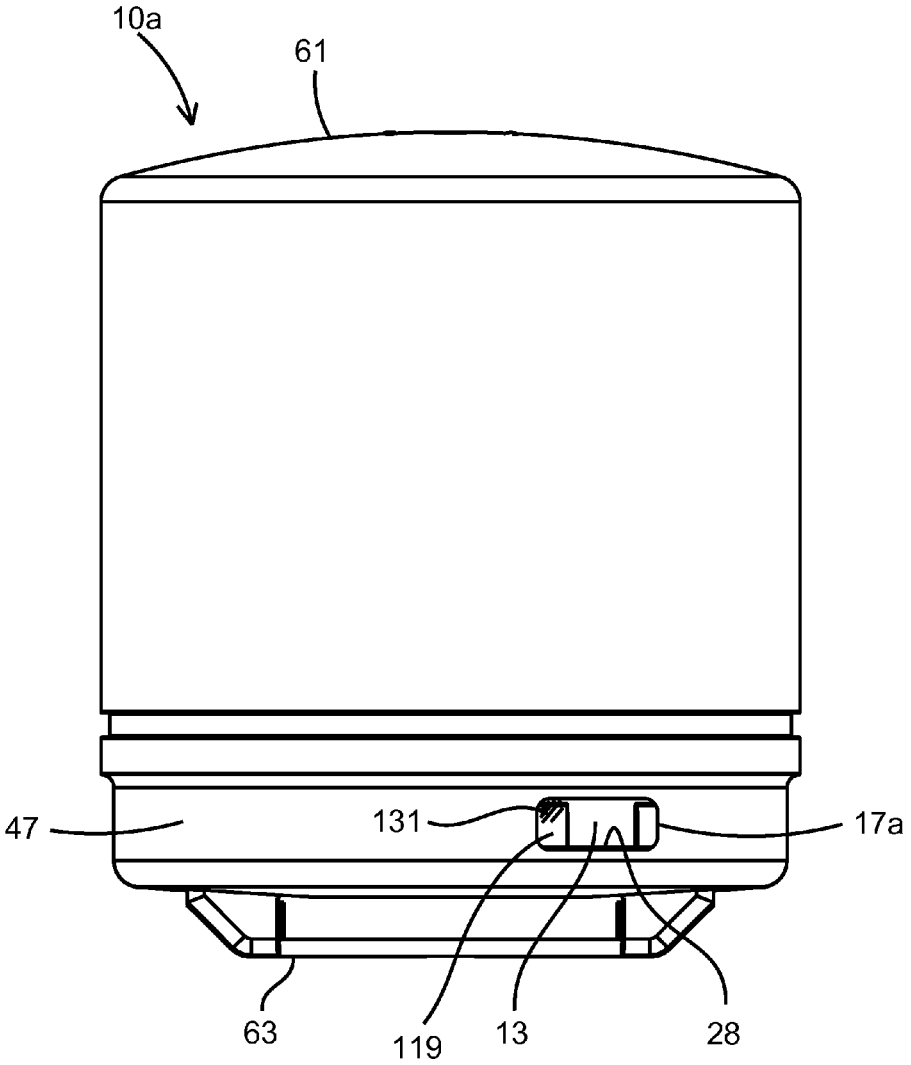
FIG. 15 is a front elevation view of the dispenser embodiment of FIG. 14 with the housing cover closed and the center pull roll in a second position indicative that the dispenser is in a low-material state.

Referring now to FIGS. 14-15, those figures illustrate a further dispenser embodiment 10*a*. Dispenser 10*a* is identical to dispenser 10 except that window 17*a* positioned in housing cover 47 toward housing bottom 63 so that the bottom edge 28 of center pull roll 13 is viewable in a gap 121 of rim 119 both before and after the center pull roll 13 moves to the second position from the first position. The description of dispenser 10 is otherwise incorporated herein by reference with respect to dispenser 10*a*. Window 17*a* could also be located below the bottom edge 28 of center pull roll 13 when in the first position so that the center pull roll 13 cannot be viewed through window 17 until it drops to the second position when looking into the window 17*a* in the plane generally parallel with the center pull roll bottom 27. The ability to view the center pull roll 13 or the center pull roll bottom edge 28 would indicate that the dispenser 10 is in the low-material state. A position indicator 133 would not be necessary in the embodiment of FIGS. 14-15 because the center pull roll 13 itself would serve as the low-material indicator when the center pull roll 13 is moving to, or is in, the second position.

FIG. 21 illustrates a further center pull dispenser embodiment 10*c*, but with center pull roll viewing structure in the form of a light-transmissive portion 48 of housing 43 through which the change of position of center pull roll 13 can be viewed. The description of dispenser 10 is otherwise incorporated herein by reference with respect to dispenser 10*c*. The light-transmissive portion 48 of housing 43 may be an integral part of the housing cover 47. A position indicator 133*a* comprising indicia in the form of a horizontal line could be superimposed on light-transmissive portion 48 of housing 43 to assist the attendant in recognizing whether the dispenser 10*c* is in the low-material state as previously described. In the example, the center pull roll top edge 26 would be even with position indicator 133*a* when the center pull roll 13 fully changes position and rests on the lower outward portion 35 of roll support platform 15. By way of further example, the light transmissive portion 48 of housing 43 could comprise the entire housing rear and cover portions 45, 47 if made of a light-transmissive material. Light-transmissive portion 48 of housing 43 could be used in combination with a window 17 if desired.

In the examples, dispenser 10, 10*a*, 10*b* and 10*c* may be made of any suitable material or materials. Preferably, housing rear portion 45, housing cover 47 and roll support platform 15 are each made of a plastic material because of ease of manufacture and cost considerations. Acrylonitrile butadiene styrene (ABS) is one example of a suitable plastic material. Other materials, such as formed metal materials may be used.

People of skill in the art will recognize that significant variation is possible with respect to the structure of the components comprising dispensers, such as dispensers 10, 10*a*, 10*b*, 10*c*, consistent with the invention. For instance, the abovementioned components are not limited to the sizes or ranges set forth above and may be sized and configured as appropriate to meet the needs of the particular purchaser of the dispenser.

Operation of the exemplary low-material-indicating structure in connection with dispenser 10 will now be described, it being understood that the low-material-indicating structure of exemplary dispensers 10*a*, 10*b* and 10*c* operates in the same manner. Referring first to FIG. 2, housing cover 47 is opened to provide access to housing interior 49. As illustrated in FIGS. 5, 12, 16 and 18, a center pull roll 13 including a web of material 11 is placed onto roll support platform 15 with axis 23 in a vertical orientation and the coiled bottom surface 27 of center pull roll inner region 29 is supported on roll support platform 15 inward portion 33. Center pull roll outer region 31 extends radially outward from inward portion 33 and overhangs roll support platform 15 outward portion 35 in the examples. This position of center pull roll 13 on inward portion 33 represents the first position of the center pull roll 13 as previously described.

With center pull roll 13 in the first position, the leading end 41 of material 11 is led from the center pull roll inner periphery 19, through central dispensing opening 107, dispenser element 109 and outlet orifice 113 and out of dispenser bottom opening 65 to the position illustrated in FIGS. 1 and 5. Wall 111 is in frictional contact with the material 11. Referring to FIG. 20, if restriction elements 114, 116 are provided, the web of material 11 is positioned between the jaw portions 118, 120 of the restriction elements 114, 116 in passageway 122 before exiting dispenser through bottom opening 65 as previously described.

As illustrated in FIGS. 1, 1-A, 5, 12-13 and 16-21, housing cover 47 is closed and secured by means of lock 127 to prevent unauthorized access to housing interior 49.

Referring to FIG. 12, the attendant can look through window 17 of dispenser 10 and can see the top edge 26 of center pull roll 13 in the first position. The position of the center pull roll 13 in the first position conveys information indicating to the attendant that the dispenser 10 has sufficient material 11 for dispensing. Position indicator 133 is behind center pull roll 13 and cannot be viewed through window 17 in this example.

Referring now to FIG. 14 and the further dispenser embodiment 10*a*, the attendant can look through window 17*a*, through gap 121 in rim 119 and can see the bottom edge 28 of center pull roll 13 in the first position. In the example, upright ramp 117 can also be seen through window 17*a*. With the center pull roll 13 in this first position, the attendant is informed that the dispenser 10 has sufficient material 11 for dispensing. As illustrated in FIG. 21, center pull roll 13 can be seen in the first position through portion 48 of housing 43.

Referring to FIGS. 1 and 5, the user grasps and pulls the leading end 41 of the web of material 11. Frictional force, or drag, provided by wall 111, opposes the pull force provided by the user. In the example of FIG. 20, restriction elements 114, 116 provide frictional force on the moving material 11. Resistance to movement of the material 11 causes the material 11 to separate along the perforation line 39 between the leading end 41 and the bottom opening 65. As a result, a single sheet 37 of material 11 is provided to the user and the leading end of the next sheet 37 is extended out of the dispenser 10 whereupon the new leading end 41 may be grasped by another user to initiate another dispensing cycle.

Over successive dispensing cycles, the web of material 11 is unwound further from the inner periphery 19 and the radial thickness of the center pull roll 13 gradually diminishes from the center pull roll inner periphery 19 toward the center pull roll outer periphery 21 as the material 11 is pulled from the dispenser 10. The coiled bottom surface 27 resting on roll support platform 15 inward portion 33 is consumed as the material 11 is unwound from the center pull roll 13 with the center pull roll 13 inner region 29 being depleted before the center pull roll outer region 31. The center pull roll 13 remains in the first position as long as center pull roll inner region 29 continues to be supported by roll support platform 15 inward portion 33.

Referring next to FIGS. 13, 17 and 19, after further successive dispensing cycles, material 11 is unwound further from the inner periphery 19 and the coiled bottom surface 27 corresponding to inner region 29 is consumed and fully depleted leaving only the center pull roll outer region 31. Consumption of the coiled bottom surface 27 corresponding to inner region 29 removes support of center pull roll 13 on the inward portion 33 of the roll support platform 15 causing center pull roll 13 to drop down onto the lower outward portion 35 of the roll support platform 15. This position of center pull roll 13 on the lower outward portion 35 of the roll support platform 15 represents the second position of the center pull roll 13 as previously described. Falling downward movement of center pull roll 13 to the second position from the first position can be immediate or gradual depending on whether a taper is provided in ramp 117 as previously described. Material 11 can be unwound from center pull roll inner periphery 19 after the center pull roll 13 has dropped onto roll support platform lower outward portion 35 until all of the material 11 has been unwound from center pull roll 13.

Referring to FIG. 13 and the dispenser embodiment 10, the attendant is able to look through window 17 and see the change of center pull roll 13 position indicative that the center pull roll 13 is in the second position and is in the low-material state. In the example, position indicator 133 is no longer hidden behind center pull roll 13 and top edge 26 of center pull roll 13 and position indicator 133 can be seen through window 17 once center pull roll 13 has dropped to the second position. Movement of the center pull roll 13 to the second position conveys information indicating to the attendant that the dispenser 10 is low on material 11 (i.e., is approaching complete depletion of material 11) and that a new center pull roll 13 of material 11 must be loaded into the dispenser 10.

Referring to FIG. 15 and the further dispenser embodiment 10*a* illustrated therein, the center pull roll 13 is shown in the second position as indicated by the center pull roll bottom edge 28 and roll outer periphery 21 being visible through window 17*a*. The attendant can take appropriate action to re-load the dispenser 10*a* with a new center pull roll 13 once movement of the center pull roll 13 to the second position has been noticed by looking through window 17*a*. Referring to FIG. 21, the attendant can view the change of center pull roll 13 position through the light-transmissive portion 48 of housing 43.

The exemplary dispensers 10, 10*a*, 10*b* and 10*c* take advantage of the inside to outside unwinding of a center pull roll 13 which enables the center pull roll 13 to change position and to move to the second position from the first position simply by the force of gravity once the coiled center pull roll bottom 27 corresponding to center pull roll inner region 29 is consumed. The change of center pull roll 13 position viewed through window 17 or 17*a* or light-transmissive portion 48 of housing 43 in the examples informs the attendant that a new center pull roll 13 should be loaded in the dispenser 10. The downward movement of the center pull roll 13 is utilized to provide a low-material indication which is communicated to the attendant in various ways, such as those of the examples described herein. No mechanical apparatus are required to move the center pull roll 13 to the second position from the first position. The elegant configuration of the exemplary dispenser 10, and dispensers 10*a*, 10*b* and 10*c*, provides the opportunity for an inexpensive and simple center pull dispenser which provides a reliable low-material indication.

While the principles of this invention have been described in connection with specific embodiments, it should be understood clearly that these descriptions are made only by way of example and are not intended to limit the scope of the invention.

The invention claimed is:

1. A low-material-indicating center pull dispenser for dispensing a web of material from a substantially vertically-oriented center pull roll having a coiled bottom surface with inner and outer regions, the dispenser comprising:

a housing permitting at least a portion of a center pull roll to be viewed when loaded therein and having an outlet for the material;

at least one center pull roll position indicator associated with the housing; and a roll support platform for supporting the center pull roll within the housing, the roll support platform having (a) an inward portion and (b) a lower outward portion outward from and at least about 0.25 inch below the inward portion, the inward portion being positioned to support the center pull roll bottom surface inner region in a first position with the center pull roll bottom surface outer region extending out from the inward portion and spaced at least about 0.25 inch above the lower outward portion, and the lower outward portion being positioned to receive and support the center pull roll bottom surface outer region in a second position when the material forming the center pull roll bottom surface inner region is depleted so that the entire center pull roll changes position by dropping at least about 0.25 inch onto the lower outward portion and dropping of the center pull roll onto the lower outward portion changes the position of the center pull roll relative to the at least one position indicator to thereby provide a low-material indication.

2. The center pull dispenser of claim 1 wherein the housing further includes center pull roll viewing structure permitting the change of position of the center pull roll to be viewed relative to the at least one position indicator.

3. The center pull dispenser of claim 2 wherein the center pull roll viewing structure comprises at least one window.

4. The center pull dispenser of claim 3 wherein the at least one window is located on the housing so that the center pull roll (a) is viewable both before and after the change of center pull roll position, or (b) is viewable only before the change of center pull roll position or (c) is viewable only after the change of center pull roll position.

5. The center pull dispenser of claim 3 wherein the at least one window is located on a housing cover.

6. The center pull dispenser of claim 3 further comprising a light-transmissive cover over the at least one window.

7. The center pull dispenser of claim 2 wherein the center pull roll viewing structure comprises a light-transmissive portion of the housing permitting the position of the center pull roll to be viewed through the housing.

8. The center pull dispenser of claim 7 wherein the light-transmissive portion of the housing is located on a housing cover.

9. The center pull dispenser of claim 1 wherein the roll support platform inward portion has a surface on which the center pull roll bottom surface inner region rests and the roll support platform inward portion further defines a central dispensing opening through which the material is pulled from the center pull roll.

10. The center pull dispenser of claim 9 wherein the roll support platform lower outward portion is concentric with the roll support platform inward portion.

11. The center pull dispenser of claim 10 further comprising a ramp spacing the roll support platform inward portion above the roll support lower outward portion and the ramp tapers outwardly toward the roll support platform lower outward portion.

12. The center pull dispenser of claim 10 further comprising an upright rim around the roll support platform lower outward portion.

13. The center pull dispenser of claim 9 further comprising at least one friction-providing surface which contacts the material pulled through the central dispensing opening so that a single sheet of material grasped by a user separates from an adjacent sheet along a perforation line.

14. The center pull dispenser of claim 13 further comprising a dispenser element extending away from the roll support platform in communication with the central dispensing opening and the friction-providing surface comprises a dispenser element wall defining an orifice through which the material is pulled from the center pull roll.

15. A low-material-indicating center pull dispenser for dispensing a web of material from a substantially vertically-oriented center pull roll having a coiled bottom surface with inner and outer regions, the dispenser comprising:

a housing permitting at least a portion of a center pull roll to be viewed when loaded therein and having an outlet for the material;

at least one center pull roll position indicator associated with the housing; and a roll support platform with an upper inward portion and a lower outward portion outward from and at least about 0.25 inch below the upper inward portion, the upper inward portion supporting the center pull roll within the housing with the center pull roll in a first position in which the inner region of the center pull roll bottom surface is supported by the roll support platform upper inward portion with the outer region of the center pull roll bottom surface overhanging the lower outward portion and, once the inner region of the center pull bottom surface is depleted, the lower outward portion supports the entire remaining center pull roll in a second position at least about 0.25 inch lower than the first position and movement of the center pull roll to the second position changes the position of the center pull roll relative to the at least one position indicator to thereby provide a low-material indication.

16. The center pull dispenser of claim 15 wherein the housing further includes center pull roll viewing structure permitting the position of the center pull roll to be viewed relative to the at least one position indicator.

17. The center pull dispenser of claim 16 wherein the center pull roll viewing structure is selected from the group consisting of at least one window, a light-transmissive housing and a light-transmissive housing portion.

18. A low-material-indicating center pull dispenser for dispensing a web of material from a substantially vertically-oriented center pull roll having a coiled bottom surface with inner and outer regions, the dispenser comprising:

a housing having an outlet for the material;

a center pull roll position indicator associated with the housing; and a roll support platform for supporting the center pull roll within the housing, the roll support platform having (a) an inward portion and (b) a lower outward portion outward from and at least about 0.25 inch below the inward portion, the inward portion being positioned to support the center pull roll bottom surface inner region with the center pull roll at a first position and the center pull roll bottom surface outer region overhanging the lower outward portion and the lower outward portion being positioned to support the center pull roll bottom surface outer region with the center pull roll at a second position at least about 0.25 inch below the first position when the material forming the center pull roll bottom surface inner region is depleted and the center pull roll changes position by falling downward onto the lower outward portion, wherein falling of the center pull roll to the lower outward portion uncovers the position indicator to thereby provide a low-material indication.

19. The center pull dispenser of claim 18 further comprising center pull roll viewing structure permitting the center pull roll to be viewed when loaded in the housing, the center pull roll viewing structure being selected from the group consisting of at least one window, a light-transmissive housing and a light-transmissive housing portion.

20. The center pull dispenser of claim 18 wherein the low-material indicator includes indicia on a rear wall of the housing which is uncovered when the center pull roll falls onto the lower outward portion.

21. A low-material-indicating center pull dispenser for dispensing a web of material from a substantially vertically-oriented center pull roll having a coiled bottom surface with inner and outer regions, the dispenser comprising:

a housing having an outlet for the material;

a center pull roll position indicator associated with the housing; and a roll support platform for supporting the center pull roll within the housing, the roll support platform having (a)

an inward portion and (b) a lower outward portion outward from and at least about 0.25 inch below the inward portion, the inward portion being positioned to support the center pull roll bottom surface inner region with the center pull roll at a first position and the center pull roll bottom surface outer region overhanging the lower outward portion and the lower outward portion being positioned to support the center pull roll bottom surface outer region with the center pull roll at a second position at least about 0.25 inch below the first position when the material forming the center pull roll bottom surface inner region is depleted and the center pull roll changes position by falling downward onto the lower outward portion, wherein falling of the center pull roll to the lower outward portion covers the position indicator to thereby provide a low-material indication.

22. The center pull dispenser of claim 21 wherein the position indicator includes an upright wall spacing the inward portion of the roll support platform above the lower outward portion of the roll support platform and the upright wall is covered by the center pull roll when the center pull roll falls onto the lower outward portion.

* * * * *